US008684232B2

(12) United States Patent
Meeuwisse

(10) Patent No.: US 8,684,232 B2
(45) Date of Patent: Apr. 1, 2014

(54) COLORANT FLUID DISPENSING DEVICE FOR DISPENSING MULTIPLE COLORANT FLUIDS

(75) Inventor: Renatus Petrus Cornelis Meeuwisse, Leidschendam (NL)

(73) Assignee: Full Process S.A., Fribourg (CH)

( * ) Notice: Subject to any disclaimer, the term of this patent is extended or adjusted under 35 U.S.C. 154(b) by 182 days.

(21) Appl. No.: 13/126,521

(22) PCT Filed: Nov. 5, 2009

(86) PCT No.: PCT/NL2009/000212
§ 371 (c)(1),
(2), (4) Date: May 4, 2011

(87) PCT Pub. No.: WO2010/053355
PCT Pub. Date: May 14, 2010

(65) Prior Publication Data

US 2011/0259918 A1 Oct. 27, 2011

(30) Foreign Application Priority Data

| | | |
|---|---|---|
| Nov. 5, 2008 | (NL) | 2002172 |
| Nov. 5, 2008 | (NL) | 2002174 |
| Nov. 5, 2008 | (NL) | 2002175 |
| Nov. 5, 2008 | (NL) | 2002176 |
| Nov. 5, 2008 | (NL) | 2002177 |
| Nov. 5, 2008 | (NL) | 2002179 |

(51) Int. Cl.
*B67D 7/06* (2010.01)

(52) U.S. Cl.
USPC ..... 222/144.5; 222/145.1; 222/1; 222/16; 222/129; 222/132; 222/135

(58) Field of Classification Search
USPC ..... 222/1, 129, 132, 135, 144.5, 309, 310, 222/145.1
See application file for complete search history.

(56) References Cited

U.S. PATENT DOCUMENTS

| | | | | |
|---|---|---|---|---|
| 2,469,796 | A * | 5/1949 | Stobb et al. | 101/207 |
| 2,951,617 | A | 9/1960 | Brock | |
| 2,962,975 | A | 12/1960 | Camp | |
| 3,029,847 | A | 4/1962 | Baudhuin et al. | |
| 4,046,287 | A * | 9/1977 | Hoekstra et al. | 222/16 |

(Continued)

FOREIGN PATENT DOCUMENTS

| | | | |
|---|---|---|---|
| CA | 2019579 | A1 | 12/1990 |
| DE | 30 02 731 | A1 | 7/1981 |

(Continued)

*Primary Examiner* — Paul R Durand
*Assistant Examiner* — Jeremy W Carroll
(74) *Attorney, Agent, or Firm* — Hoffmann & Baron, LLP

(57) ABSTRACT

Colorant fluid dispensing device (1) for dispensing multiple colorant fluids, comprising more than one fluid container (2) at least one dispenser outlet (3), wherein the fluid containers are in fluid connection with the at least one dispenser outlet via pumping means (4) the pumping means comprises more than one piston pump (5), each piston pump comprises a central pump tube (15) in which a piston (20) is provided with a piston rod (21) for moving the piston inside the central pump tube, the colorant fluid dispensing device further comprises driving means (36) for moving the piston rods of said piston pumps, control means (38) for controlling the driving means, and the driving means comprises a movable selector (37) configured to engage the piston rods of a selection.

14 Claims, 14 Drawing Sheets

(56) References Cited

U.S. PATENT DOCUMENTS

| | | | | |
|---|---|---|---|---|
| 4,946,100 | A | 8/1990 | Flemming et al. | |
| 4,967,938 | A * | 11/1990 | Hellenberg | 222/144 |
| 5,118,199 | A | 6/1992 | Howk | |
| 5,119,973 | A * | 6/1992 | Miller et al. | 222/144 |
| 5,407,100 | A * | 4/1995 | Tracy et al. | 222/137 |
| 5,558,251 | A * | 9/1996 | Neri | 222/135 |
| 6,015,268 | A * | 1/2000 | Hetherington | 417/63 |
| 6,637,471 | B2 * | 10/2003 | Luehrsen et al. | 141/83 |
| 2003/0085237 | A1 * | 5/2003 | Kateman et al. | 222/1 |
| 2005/0252934 | A1 * | 11/2005 | Miller et al. | 222/135 |
| 2007/0012378 | A1 * | 1/2007 | Miller et al. | 141/104 |
| 2010/0206902 | A1 * | 8/2010 | Engels et al. | 222/135 |
| 2011/0108577 | A1 * | 5/2011 | Chassaing | 222/144 |

FOREIGN PATENT DOCUMENTS

| | | | |
|---|---|---|---|
| EP | 0232 814 | A1 | 8/1987 |
| EP | 0 715 883 | A1 | 12/1996 |
| EP | 0 786 287 | A1 | 7/1997 |
| EP | 1 334 920 | A1 | 8/2003 |
| GB | 930377 | | 7/1963 |
| GB | 2 416 757 | A | 2/2006 |
| WO | 96/36556 | A1 | 11/1996 |
| WO | 2006/044585 | A2 | 4/2006 |

* cited by examiner

COLORANT FLUID DISPENSING DEVICE FOR DISPENSING MULTIPLE COLORANT FLUIDS

CROSS-REFERENCE TO RELATED APPLICATIONS

This application is the National Stage of International Application No. PCT/NL2009/000212, filed Nov. 5, 2009, which claims the benefit of Netherlands Application Nos. NL 2002172, filed Nov. 5, 2008; NL 2002174, filed Nov. 5, 2008; NL 2002175, filed Nov. 5, 2008; NL 2002176, filed Nov. 5, 2008; NL 2002177, filed Nov. 5, 2008; and NL 2002179, filed Nov. 5, 2008; the contents of all of which are incorporated by reference herein.

FIELD OF THE INVENTION

The invention relates to a colorant fluid dispensing device for dispensing multiple colorant fluids.

SUMMARY OF THE INVENTION

The colorant fluid dispensing device comprises more than one fluid container for containing a colorant fluid and at least one dispenser outlet for dispensing the colorant fluids of the fluid containers. The fluid containers are in fluid connection with the at least one dispenser outlet via pumping means for pumping said colorant fluids of the fluid containers out of the at least one dispenser outlet. The pumping means comprises at least one piston pump.

The piston pump may be a double acting piston pump. This has the advantage that the dispensing device operates faster. The double acting piston pump allows elimination of the step of sucking colorant fluid from the fluid containers before dispensing said colorant fluid. With the double acting piston pump the sucking of colorant fluid from the fluid container is in use performed simultaneously with the dispensing of said colorant fluid. This means that the colorant fluid is faster dispensable from the at least one dispenser outlet, which leads to a faster operating dispensing device.

In an embodiment of the colorant fluid dispensing device according the invention, the double acting piston pump is connected to a fluid container via a first fluid connection and to a dispenser outlet via a second fluid connection, and the second fluid connections comprises a three-way valve which is via a third fluid connection connected to the fluid container being connected to said piston pump.

Each three-way valve may be changeable between a first setting in which a fluid flow between the double acting piston pump and the dispenser outlet is allowed and a fluid flow between the double acting piston pump and the fluid container is blocked and a second setting in which a fluid flow between the double acting piston pump and the dispenser outlet is blocked and a fluid flow between the double acting piston pump and the fluid container is allowed.

The double acting piston pump ensures that during circulation of the colorant fluid from the fluid container, through said pump and back to said fluid container, subsequently no fluctuations in the level of colorant fluid in the fluid containers occurs.

When a single acting piston pump is used, said single acting piston pump continuously first subtracts colorant fluid from and then discharges said colorant fluid in the fluid container such that the level of colorant fluid in said fluid container fluctuates. Due to the fact that the double acting piston pump simultaneously sucks and pumps the colorant fluid, the colorant fluid is subtracted and discharged such that substantially no fluctuations in the level of colorant fluid in the fluid container occurs during the above mentioned circulation of colorant fluid.

When the level of colorant fluid in the fluid container fluctuates, there is a relatively large air exchange between the colorant fluid and the air in the fluid container. This air exchange has as a result that the fluid container in the colorant fluid more rapidly dries out. Therefore, with the double acting piston pump a significant reduction in the drying out of colorant fluid located in the fluid container is achieved.

In a further embodiment of the colorant fluid dispensing device according the invention, the double acting piston pump comprises a pump inlet for letting in the colorant fluid and a pump outlet for letting out the colorant fluid.

The double acting piston pump may comprise a central pump tube and a piston movable arranged in the central pump tube, the central pump tube may comprise a first tube end and a second tube end, the double acting piston pump may be configured to pump colorant fluid out of the pump outlet when the piston is moved towards the first tube end and to pump colorant fluid out of the pump outlet when the piston is moved towards the second tube end.

Each of the least one double acting piston pump may be in fluid connection with a different fluid container. Each of the at least one double acting piston pump may be in fluid connection with a different dispenser outlet.

The colorant fluid dispensing device may comprise a base frame for positioning the colorant fluid dispensing device in a use position on a surface.

The central pump tubes of the double acting piston pumps in said use position may extend substantially parallel to said surface. The central pump tubes of the double acting piston pumps in said use position may extend substantially horizontal.

In said use position the pump outlet of the double acting piston pump may be located at a larger distance from said surface than the pump inlet thereof. This ensures that no air builds up in said double acting piston pump.

The pump inlet and the pump outlet of the double acting piston pump may be positioned such that in the use position a plane extending through the pump inlet and the pump outlet extends substantially perpendicular to said surface.

In an embodiment of the colorant fluid dispensing device according the invention, the double acting piston pump comprises a first duct which is near or at an end thereof connected to the central pump tube via a first valve and near or at an other end thereof connected to the central pump tube via a second valve, a second duct which is near or at an end thereof connected to the central pump tube via a third valve and near or at an other end thereof connected to the central pump tube via a fourth valve, the pump inlet is in fluid connection with the first duct, and the pump outlet is in fluid connection with the second duct.

In the use position the central pump tube may extend substantial parallel to said surface. In the use position the central pump tube may extend substantial horizontal.

In the use position the second duct may be located at a larger distance for the surface than the first duct. In the use position the second duct may be located above the first duct.

The central pump tube, first duct and second duct may extend substantially parallel to each other.

The first duct and the second duct are substantially of the same length.

In an embodiment of the colorant fluid dispensing device according the invention, the double acting piston pump comprises a piston rod connected to the piston for moving the piston inside the central pump tube, the inside of the central pump tube comprise a first cross sectional area extending substantially perpendicular to a longitudinal axis of the central pump tube the piston rod in use extends at least partly through the inside of the central pump tube, the part of the piston rod in use extending through the inside of the central pump tube comprises a second cross sectional area extending substantially perpendicular to a longitudinal axis of the piston rod, the second cross sectional area is between the 0.02 and 0.2 times the first cross sectional area. This has the advantage that between 2 and 20% less colorant fluid is dispensed when the piston rod is moved out of the central pump tube (moving outwards) than when said piston rod is moved in said central pump tube (moving inwards). This allows a more accurate dispensing of colorant fluid when the piston rod is moved outwards.

The central pump tube may comprise a first end and a second end, the first valve and the fourth valve may be located near or at said first end of the central pump tube, the second valve and the third valve may be located near or at said second end of the central pump tube.

The double acting piston pump may be configured such that for pumping the colorant fluid out of the pump outlet the first valve and the third valve are closed and the second valve and fourth valve are open when the piston is moved towards said first end of the central pump tube, and the first valve and the third valve are open and the second valve and fourth valve are closed when the piston is moved towards said second end of the central pump tube.

The double acting piston pump may be configured to move the piston towards the first end of the central pump tube by moving the piston rod out of the central pump tube and to move the piston towards the second end of the central pump tube by moving the piston rod in the central pump tube.

In an embodiment of the colorant fluid dispensing device according the invention, the double acting piston pump comprises a second inlet and a second outlet, the first inlet is in fluid connection with a first fluid container, the second inlet is in fluid connection with a second fluid container, the double acting piston pump is configured to pump a first colorant fluid from the first fluid container out of the first pump outlet and to pump a second colorant fluid from the second fluid container out of the second pump outlet. This allows the dispensing of two different colorant fluids with one double acting piston pump.

The double acting piston pump may be configured such that in use the first colorant fluid and the second colorant fluid during the pumping out of the first pump outlet and/or the second pump outlet remain separated from each other.

The colorant fluid dispensing device may comprise one or more of any feature further disclosed in this patent (application). An example of such a colorant fluid dispensing device is shown in the accompanying FIGS. 1-14.

The invention further relates to a colorant fluid dispensing device comprising more than one fluid container for containing a colorant fluid, and at least one dispenser outlet for dispensing the colorant fluids of the fluid containers. The fluid containers are in fluid connection with the at least one dispenser outlet via pumping means for pumping said colorant fluids of the fluid containers out of the at least one dispenser outlet. The pumping means comprises more than one piston pump. Each piston pump comprises a central pump tube in which a piston is provided. The piston is connected to a piston rod for moving the piston inside the central pump tube. The colorant fluid dispensing device further comprises driving means for moving the piston rods of said piston pumps, control means for controlling the driving means, and input means for providing a first input to the control means. The first input indicates a selection of at least one piston rod, and the driving means comprises a movable selector configured to engage the at least one piston rod of the selection such that the at least one piston rod of the selection is movable along with the selector without moving the piston rods not part of the selection.

Each piston pump may be in fluid connection with a different fluid container.

Each piston pump may be in fluid connection with a different dispenser outlet.

The more than one piston pumps may be more than one double acting piston pump as disclosed in this patent (application). Each piston pumps may be a double acting piston pump as disclosed in this patent (application).

This has the advantage that only the piston rods of the selection are moved. The selection may be determined by the wished colour indicated by the first input. This means that only the piston rods which are required for the whished colour are moved. In practise this means that during the operation of the dispensing device, only part of the piston rods are moved. This allows that the driving means can be adjusted to the reduced amount of piston rods that have to move, which may result in the use of a less powerful (and thus less expensive) driving means.

A further advantage is that the piston pumps are less subjected to wear and that less colorant fluid is circulated from the fluid container, trough the pump and back to the fluid container. Furthermore, there is smaller risk to the piston pumps are damaged, for example by the fact that the dispenser outlet is clogged up.

In the situation of a clogged up dispenser outlet, it is advantageous to use a less powerful driving means, due to the fact that said driving means is less destructive for the pumping means of the clogged up dispenser outlet.

In an embodiment of the colorant fluid dispensing device according the invention, the selector comprises engage means configured to engage or disengage at least one of the piston rods such that engaged piston rods are movable by the selector without moving disengaged piston rods, and the control means is configured to control the engage means such that the engage means engage the piston rods of the selection and disengage the piston rods not part of the selection.

The selector may be movable along a selector trajectory from a start position to an end position and the control means may be configured to change the engagement and disengagement of the engage means only when the selector is positioned in the start position.

The piston pumps may be double acting piston pumps, the input means may be configured to provide a second input to the control means, which second input indicates a quantity of colorant fluid to be dispensed by each of the double acting piston pumps of said selection and out of the at least one dispenser outlet, the control means may be configured to control the drive means such that the selector is moved from the start position to a return position located on the selector trajectory and back to the start position, said return position being determined by the largest displacement of the piston rods of the selection required for dispensing the indicated quantity of colorant fluid.

The return position may be chosen such that the displacement of the selector from the start position to the return position and back to the start position equals the largest displacement of the piston rods of the selection required for dispensing the indicated quantity of colorant fluid.

The return position may be chosen such that the displacement of the selector from the start position to the return position and back to the start position equals between the 1.05 and 1.15 times the largest displacement of the piston rods of said selection required for dispensing the indicated quantity of colorant fluid.

Between 5% and 15% of the movement of the selector along the trajectory may be used to build up a pressure in the colorant fluids in the piston pumps of the selection.

Each piston pump may be connected to fluid container via a first fluid connection and to a dispenser outlet via a second fluid connection, each of said said fluid connections may comprise a three-way valve which via a third fluid connection is connected to the fluid connection being in fluid connection with said piston pump and the control means may be configured to control the three-way valves during the movement of the selector along the selector trajectory such that from the colorant fluids pumped by the piston pumps of the selection the by the second input indicated quantity of each colorant fluid is dispensed out of the at least one dispenser outlet and the additional pumped colorant fluid is returned to the fluid containers.

The colorant fluid dispensing device may comprise a base frame for positioning the colorant fluid dispensing device in a use position on a surface and the central pump tubes of the piston pumps may in said use position extend substantially parallel to said surface. The central pump tubes of the piston pumps may in said use position extend substantially horizontal.

The double acting piston pump may comprise a pump inlet for letting in the colorant fluid and a pump outlet for letting out the colorant fluid. In said use position the pump outlet of the double acting piston pump may be located at a larger distance from said surface than the pump inlet thereof. The pump inlet and the pump outlet of the double acting piston pump may be positioned such that in the use position a plane extending through the pump inlet and the pump outlet extends substantially perpendicular to said surface. The pump inlet and the pump outlet of the double acting piston pump may in the use position be positioned substantially vertical.

The invention further relates to a method for dispensing a colorant fluid with a colorant fluid dispensing device comprising more than one fluid container for containing a colorant fluid, at least one dispenser outlet for dispensing the colorant fluids of the fluid containers, wherein the fluid containers are in fluid connection with the at least one dispenser outlet via pumping means for pumping said colorant fluids of the fluid containers out of the at least one dispenser outlet, the pumping means comprises more than one piston pump, each piston pump comprises a central pump tube in which a piston is provided, the piston being connected to a piston rod for moving the piston inside the central pump tube, the colorant fluid dispensing device further comprises driving means for moving the piston rods of said piston pumps, control means for controlling the driving means, and input means for providing a first input to the control means, which first input indicates a selection of at least one piston rod, and the driving means comprises a movable selector, said method comprising the step of engaging the at least one piston rod of the selection with the selector such that the at least one piston rod of the selection is movable along with the selector without moving the piston rods not part of the selection.

The method may comprising moving of the selector such that the at least one piston rod of the selection is moved along with the selector without moving the piston rods not part of the selection.

For service, maintenance and initialisation purposes, the selector may also be moved without selecting any piston rod.

The colorant fluid dispensing device and method may comprise one or more of any feature further disclosed in this patent (application). An example of such a colorant fluid dispensing device is shown in the accompanying FIGS. 1-14.

The invention further relates to a colorant fluid dispensing device comprising more than one fluid container for containing a colorant fluid, and at least one dispenser outlet for dispensing the colorant fluids of the fluid containers. The fluid containers are in fluid connection with the at least one dispenser outlet via pumping means for pumping said colorant fluids of the fluid containers out of the at least one dispenser outlet. Each fluid container comprises a longitudinal axis and stir means for stirring the colorant fluid in the container. The stir means comprises a stir member which is located inside the fluid container and is rotatable around a rotation axis. The rotation axis extends traverse to the longitudinal axis of the fluid container.

This way a circulation of the colorant fluid in the fluid container is achieved, which circulation runs from the lower part of the fluid container, upwards to the upper part of the fluid container and subsequently downwards back to said lower part. Said circulation flow of colorant fluid allows the use of fluid containers with a cross section (subsequently perpendicular to the longitudinal axis of the fluid container) comprising edges. Said cross section may be a rectangular or square.

In an embodiment of the colorant fluid dispensing device according the invention, the rotation axis extends under a rotation angle of between 450-1350, preferably between 800-1000, relative to the longitudinal axis of the fluid container.

The rotation axis may extend substantially perpendicular relative to the longitudinal axis of the fluid container.

Each fluid container may comprise a lower part and the stir member may be located in said lower part.

Each fluid container may comprise a bottom. A fluid guide may be provided inside each fluid container. The stir member may be located between said bottom and fluid guide.

Each stir member may comprise a bottom stir element and the stir member is configured to move the bottom stir element in the proximity of the bottom.

The fluid guide may comprise a plate like body extending substantially parallel to the longitudinal axis of the fluid container. The fluid guide may extend through the longitudinal axis of the fluid container.

Each fluid container may comprise a bottom and the stir member may be located adjacent to the bottom. The bottom may comprise a concave like form. The stir member may be configured such that the form thereof corresponds to the form of the bottom.

The stir means may comprise a rotation drive for rotating the stir members around the rotation axis. The stir member of each fluid container may be driven by a different rotation drive. The stir means may comprise a stir control for controlling the rotation speed of each stir member and a sensor means for determining the level of colorant fluid in each of the fluid containers. The stir control may be configured to adjust the rotation speed of each stir member to the level of colorant fluid in the corresponding fluid container. The rotation speed may be controlled such that the rotation speed increases when the level of colorant fluid increases and that the rotation speed decreases when the level of colorant fluid decreases.

The stir members of more than one fluid container may be driven by one rotation drive. The stir means may comprise a stir control for controlling the rotation speed of the stir members of the fluid containers driven by said one rotation drive and a sensor means for determining the level of colorant fluid in each of the fluid containers. The stir control may be configured to adjust the rotation speed of the stir members of the fluid containers driven by said one rotation drive to the lowest level of colorant fluid in the fluid containers driven by said one rotation drive. The rotation speed may be controlled such that the rotation speed increases when the lowest level of colorant fluid increases and that the rotation speed decreases when the lowest level of colorant fluid decreases. The stir control may be configured to adjust the rotation speed of the stir members of the fluid containers driven by said one rotation drive to the average level of colorant fluid in the fluid containers stirred by said one rotation drive. The rotation speed may be controlled such that the rotation speed increases when the average level of colorant fluid increases and that the rotation speed decreases when the average level of colorant fluid decreases.

The stir member may comprise blades for moving colorant fluid in a direction along the rotation axis. The fluid guide may extend substantially perpendicular to the rotation axis. The fluid guide may extends under an angle of between 600-900, preferably between 700-850, relative to the rotation axis.

The colorant fluid dispensing device may comprise one or more of any feature further disclosed in this patent (application). An example of such a colorant fluid dispensing device is shown in the accompanying FIGS. 1-14.

The invention further relates to a colorant fluid dispensing device comprising more than one fluid container for containing a colorant fluid, and more than one dispenser outlet for dispensing the colorant fluids of the fluid containers. The fluid containers are in fluid connection with the dispenser outlets via pumping means for pumping said colorant fluids of the fluid containers out of the dispenser outlets. The pumping means comprises more than one pump. The colorant fluid dispensing device comprises control means for controlling the pumping means. The control means comprises time measuring means and is configured to activate the pumping means such that a small quantity of colorant fluid is dispensed out of one of the dispenser outlets when said dispenser outlet has not dispensed a colorant fluid for a predetermined time period. This has as advantage that the colorant fluid in the dispenser outlets does not dry out, which ensures that the dispenser outlets do not get clogged up.

In an embodiment of the colorant fluid dispensing device according the invention, the more than one pumps are double acting piston pumps, each of the double acting piston pump is connected to a fluid container via a first fluid connection and to a dispenser outlet via a second fluid connection, and the second fluid connection comprises a three-way valve which via a third fluid connection is connected to the fluid container being connected to said double acting piston pump.

In an embodiment of the colorant fluid dispensing device according the invention, each pump is in fluid connection with a different dispenser outlet, the control means are configured to activate one of the pumps when said pump is not activated for a predetermined time period such that colorant fluid is dispensed out of the dispenser outlet in fluid connection with said pump.

Said predetermined time period may be between 2 and 8 hours, preferably between 4 and 6 hours, and the small quantity of colorant fluid may be between 0.05 and 0.2 milliliter, preferably between 0.1 and 0.15 milliliter.

The colorant fluid dispensing device may comprise a sealing means for sealing the dispenser outlets such that said dispenser outlets are located in a substantially closed space. The sealing means may seal the dispenser outlets such that said dispenser outlets are located in a substantially gas tight closed space. Due to this, the colorant fluid in the dispenser outlets dries out less fast.

The sealing means may comprise receiving means for receiving and holding by the dispenser outlets dispensed colorant fluids. The colorant fluid dispensing device may comprise a total of N dispenser outlets. The receiving means may be configured to hold between N times 2 milliliter and N times 5 milliliter, preferably N times 3 milliliter and N times 4 milliliter. Said capacity of the receiving means allows to receive such an amount of colorant fluid which can cover a weekend of downtime of the dispensing device.

In an embodiment of the colorant fluid dispensing device according to the invention, the sealing means comprise a sealing member, the receiving means are provided on the sealing member, the sealing means are configured to move the sealing member between a first member position in which the receiving means do not receive colorant fluid dispensed by the dispenser outlets and a second member position in which the receiving means receive colorant fluid dispensed by the dispenser outlets. The control means may be configured to move the seal member into the first position when the dispenser outlets dispenses said small quantity of colorant fluid.

The colorant fluid dispensing device may comprise one or more of any feature further disclosed in this patent (application). An example of such a colorant fluid dispensing device is shown in the accompanying FIGS. 1-14.

The invention further relates to a method for dispensing a colorant fluid with a colorant fluid dispensing device comprising more than one fluid container for containing a colorant fluid, more than one dispenser outlet for dispensing the colorant fluids of the fluid containers, wherein the fluid containers are in fluid connection with the dispenser outlets via pumping means for pumping said colorant fluids of the fluid containers out of the dispenser outlets, the pumping means comprises more than one pump, the colorant fluid dispensing device comprises control means for controlling the pumping means, said control means comprising time measuring means, said method comprising controlling the pumping means such that the pumping means are activated to dispense a small quantity of colorant fluid out of one of the dispenser outlets when said dispenser outlet has not dispensed a colorant fluid for a predetermined time period.

Each pump may be in fluid connection with a different dispenser outlet and the method may comprise activating of one of the pumps when said pump is not activated for a predetermined time period such that colorant fluid is dispensed out of the dispenser outlet in fluid connection with said pump.

The method may comprise positioning a sealing means such that the out of the dispenser outlets dispensed colorant fluid is received by a receiving means of said sealing means. The sealing means may comprise sealing member on which the receiving means are provided and the method may comprise moving the sealing member between a first member position in which the receiving means do not receive colorant fluid dispensed by the dispenser outlets and a second member position in which the receiving means receive colorant fluid dispensed by the dispenser outlets. The method may comprise moving the seal member into the second member position when the dispenser outlets dispense said small quantity of colorant fluid.

The method may comprise one or more of any feature further disclosed in this patent (application). An example of such a method is shown in the accompanying FIGS. 1-14.

The invention further relates to a colorant fluid dispensing comprising more than one fluid container for containing a colorant fluid and at least one dispenser outlet for dispensing the colorant fluids of the fluid containers. The fluid containers are in fluid connection with the dispenser outlet via pumping means for pumping said colorant fluids from the fluid container out of the at least one dispenser outlet. Each fluid container comprises an inlet opening for letting in colorant fluid to fill the fluid container, a container lid for closing the inlet opening, and lid connection means for connecting the container lid to the fluid container. The lid connection means are configured to position the container lid in a shielding position to block splashes of colorant fluid during the filling of the fluid container.

This provides the advantage that a shield against the splashing of the colorant fluid during the filling of the fluid containers is achieved.

The lid connecting means may be configured such that the container lid is movable between a closing position in which the container lid closes the fluid container and the shielding position while being connected to the fluid container. This avoids placing of a container lid on the wrong fluid container. If a container lid is positioned on a wrong fluid container, there is a high risk of contamination of the colorant fluid located in said fluid container. Moreover, because typically the type of colorant is marked on the lid.

In an embodiment of the colorant fluid dispensing device according the invention, the lid connection means are configured to position the container lid in the inlet opening such that the container lid extends out of the inlet opening.

Each fluid container may comprise a longitudinal axis and the lid connection means may be configured to position the container lid such that the container lid extends traverse to the longitudinal axis of the fluid container.

The lid connection means may be configured to position the container lid such that the container lid extends under a lid angle of between 00-600, preferably between 350-550, relative to the longitudinal axis of the fluid container.

The lid connection means may be configured to position the container lid in a substantially upright position.

The container lid may comprise holding means for in use holding a colorant fluid holder, such as a colorant fluid can, in a filling position such that the colorant fluid of the colorant fluid holder flows in the inlet opening of the fluid container.

The lid connection means and the holding means may be configured to position the colorant fluid holder in such a position that gravity drives said colorant fluid out of the colorant fluid holder and into the inlet opening of the fluid container.

The holding means may be configured such that in use a longitudinal axis of the colorant fluid holder held by the holding means extends traverse to the longitudinal axis of the fluid container.

The holding means may be configured such that in use a longitudinal axis of the colorant fluid holder held by the holding means extends substantially parallel to the container lid.

The colorant fluid dispensing device may comprise one or more of any feature further disclosed in this patent (application). An example of such a colorant fluid dispensing device is shown in the accompanying FIGS. 1-14.

The invention further relates to a colorant fluid dispensing device comprising more than one fluid container for containing a colorant fluid and at least one dispenser outlet for dispensing the colorant fluids of the fluid containers. The fluid containers are in fluid connection with the at least one dispenser outlet via pumping means for pumping said colorant fluids from the fluid containers out of the at least one dispenser outlet. Each fluid container comprises an inlet opening for letting in colorant fluid to fill the fluid container and a container lid for closing said filing opening. The container lid comprises a lid opening sealed by a flexible member. The flexible member comprises a pressure valve formed by an incision in said flexible member.

This allows sealing of the fluid container to prevent the drying out of the colorant fluid located inside such that no under pressure is created inside the fluid container.

In an embodiment of the colorant fluid dispensing device according the invention, the flexible member may substantially comprise the form of a plate. The incision may substantially comprise the form of a cross.

The inlet opening of each fluid container may be surrounded by a first closing surface and the container lid may comprise a second closing surface configured to be positioned on the first closing surface such that the container lid closes the inlet opening. The first closing surface and the second closing surface may be a flat surface. The fluid container may comprise retention means to retain the second closing surface on the first closure surface. The retention means may use a magnetic force to retain the second closing surface on the first closure surface. The retention means may comprise a magnetic member.

The colorant fluid dispensing device may comprise one or more of any feature further disclosed in this patent (application). An example of such a colorant fluid dispensing device is shown in the accompanying FIGS. 1-14.

The invention further relates to a fluid container according to the invention.

The invention further relates to a method for dispensing a colorant fluid with a colorant fluid dispensing device according to the invention.

The invention further relates to a method of filling a fluid container of a colorant fluid dispensing device according to the invention.

The invention further relates to a use of a colorant fluid dispensing device according to invention.

The invention further relates to a use of a fluid container according to the invention.

BRIEF DESCRIPTION OF THE DRAWINGS

The invention will be discussed in detail with reference to the accompanying figures, wherein.

DETAILED DESCRIPTION OF THE INVENTION

Figure 1:
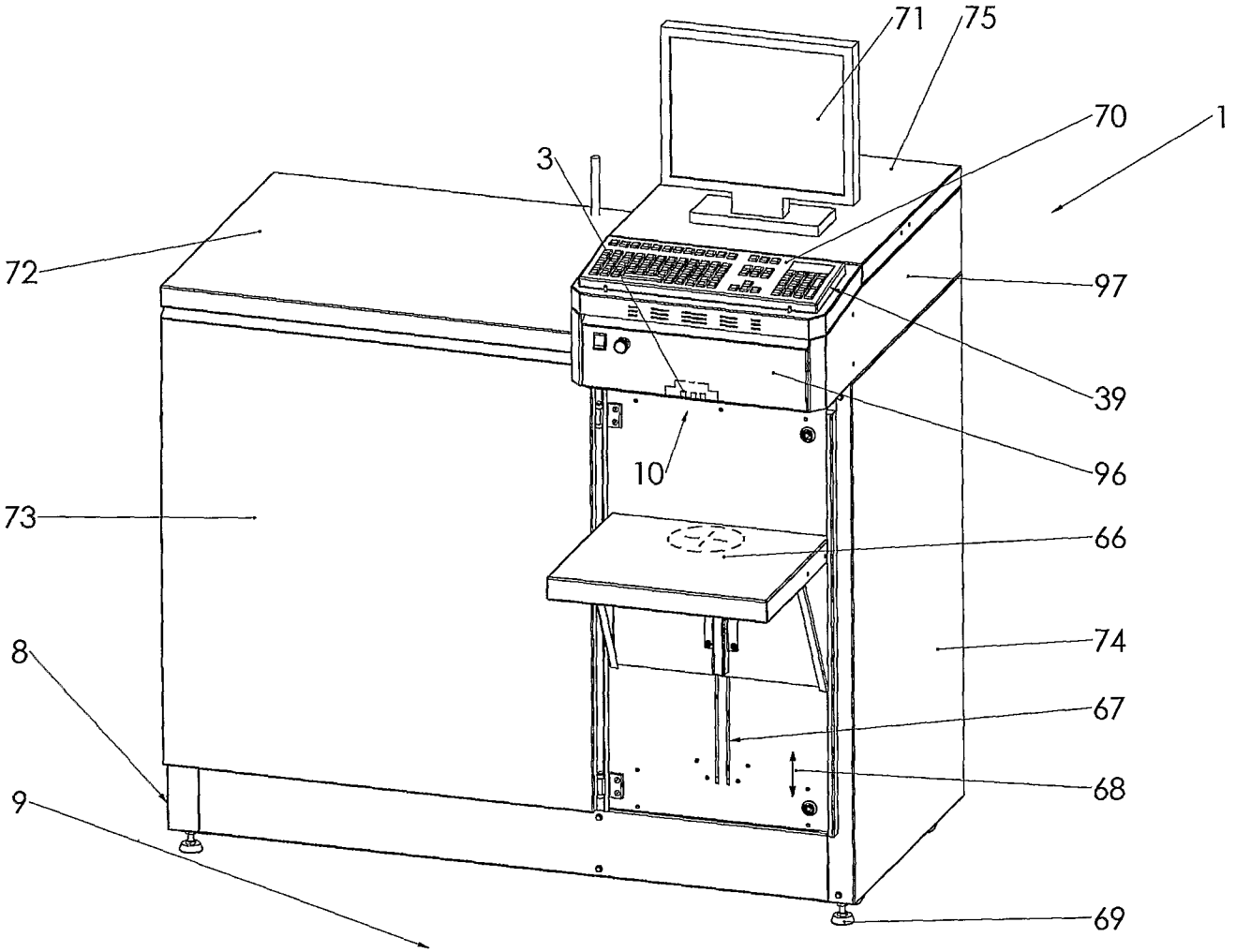
FIG. 1 schematically shows a perspective overall view of a first embodiment of the colorant fluid dispensing device according to the invention, FIG. 2 schematically shows the colorant fluid dispensing device of FIG. 1, wherein several side panels are open or removed, FIG. 3 schematically shows the pumping means and the driving means of the colorant fluid dispensing device of FIG. 1 in a perspective view, FIGS. 4 and 5 schematically show a cross sectional view of the double acting piston pump of the colorant fluid dispensing device of FIG. 1, FIG. 6 schematically shows the selector of the colorant fluid dispensing device of FIG. 1, FIG. 7 schematically shows in an enlarged view part of the engaging means of the colorant fluid dispensing device of FIG. 1, FIG. 8 schematically shows the fluid container of the colorant fluid dispensing device of FIG. 1 in a perspective view, FIG. 9 schematically shows a cross sectional view of part of the fluid container of FIG. 8 and the stir means thereof, FIG. 10 schematically shows a cross sectional view of a further embodiment of the fluid container and the stir means thereof, FIG. 11 schematically shows the fluid container of part of the colorant fluid dispensing device of FIG. 1 and the container lid thereof, FIGS. 12 and 13 schematically show a perspective view of the sealing means of the colorant fluid dispensing device of FIG. 1.

FIG. 1 shows an overall view of a first embodiment of the colorant fluid dispensing device 1. The colorant fluid dispensing device 1 is configured to dispense multiple colorant fluids and comprises a base frame 8 which is positioned on a surface 9 by feet 69. The colorant fluid dispensing device 1 is shown is positioned in its use position.

The colorant fluid dispensing device 1 comprises a dispenser member 10 with several dispenser outlets 3 for dispensing the colorant fluids. The colorant fluid dispensing device 1 may also comprise only one dispenser outlet. A fluid holder support 66 for supporting a fluid holder is provided below the dispenser outlets 3. In use, said fluid holder receives the colorant fluids dispensed by the dispenser outlets 3. The fluid holder support 66 is movable along a support trajectory 67 to and away from the dispenser outlets 3. Said directions of movement of the fluid holder support 66 are indicated by arrow 68.

Control means (38 of FIG. 2) are provided to control the functioning of the colorant fluid dispensing device 1. The control means 38 are in communication with input means 39 to provide the control means 38 with instructions. The input means 39 comprises a keyboard 70 and a display 71.

The inside of the colorant fluid dispensing device 1 is covered with several panels, such as a container cover panel 72, first side panel 73, second side panel 74, control cover panel 75, first upper panel 96 and second upper panel 97. The panels 72-75 are pivotable connected to the base frame 8. This way an access to the inside of the colorant fluid dispensing device 1 is provided.

Figure 2:
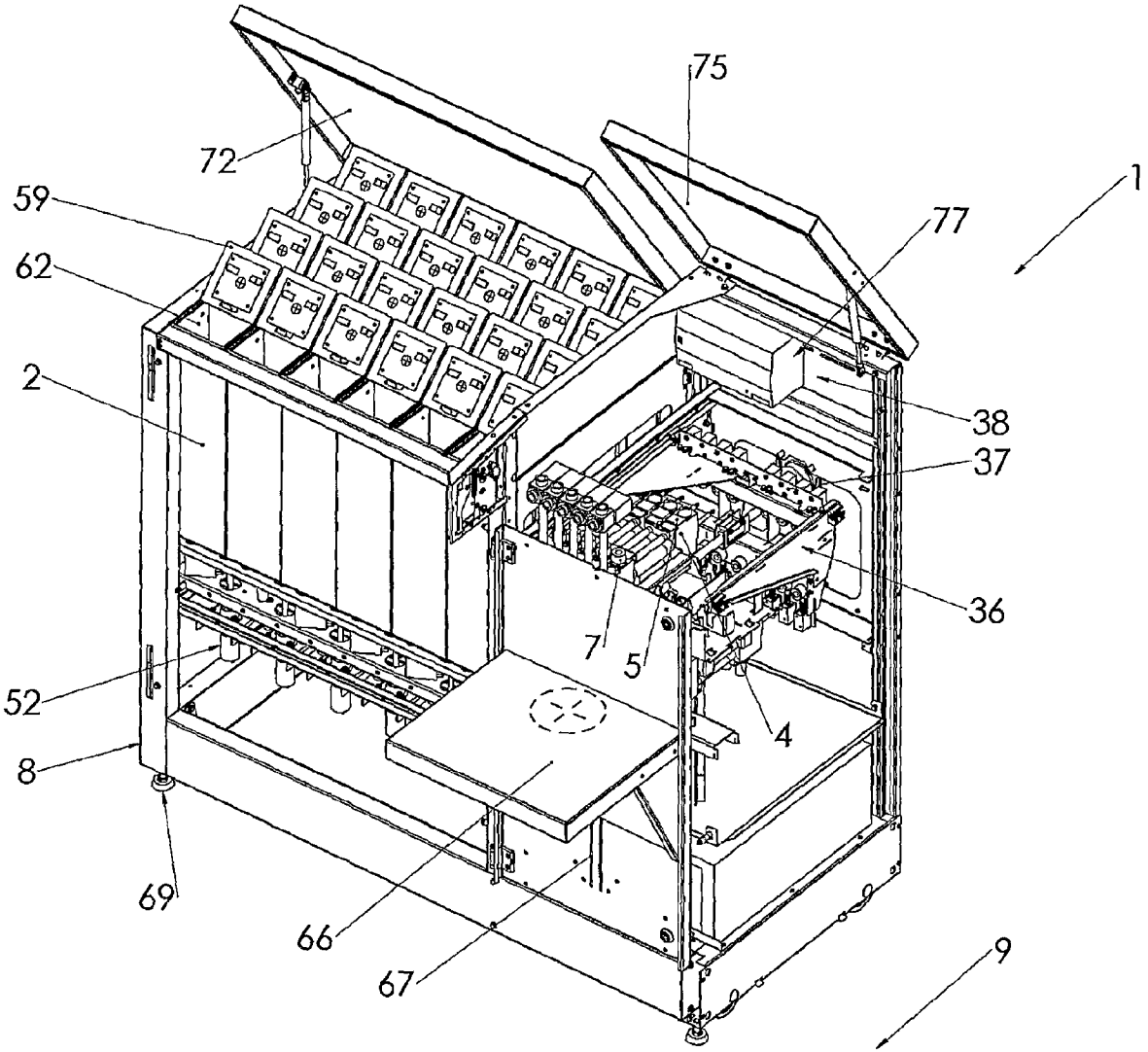

FIG. 2 shows the colorant fluid dispensing device of FIG. 1, wherein the first and second side panels are removed and the container cover panel 72 and control cover panel 73 are opened. The input means, control means and dispenser member are removed so that a clear view on the pumping means and driving means located inside the colorant fluid dispensing device 1 is provided. For clarity reasons, only part of the pumping means are shown.

The colorant fluid dispensing device 1 comprises several fluid containers 2 for containing a colorant fluid. Each fluid container 2 comprises an inlet opening 58 for filling the fluid container 2. The colorant fluid dispensing device 1 may also comprise only one fluid container 2. The fluid containers 2 are in fluid connection with the pumping means 4 by means of ducts 76. In fluid connection may mean that the fluid containers 2 are in open fluid connection or in closable fluid connection with the pumping means 4. The pumping means 4 are configured to pump the colorant fluids of the fluid containers 2 out of the dispenser outlets 3.

The pumping means 4 comprises several double acting piston pumps 5. The pumping means 4 may also comprise only at least one single acting piston pump or only one double acting piston pump 5. Each double acting piston pump 5 comprises a pump inlet (6 of FIG. 3) which is in fluid connection with a different fluid container 2 and a pump outlet 7 which is in fluid connection with a different dispenser outlet. Driving means 36 are provided for driving the pumping means 4. The driving mean 36 comprises a selector 37 for driving the double acting piston pumps 5. The double acting piston pumps 5 are connected to the base frame 8 and the selector is movable relative to the base frame 8.

Each fluid container 2 comprises stir means (44 of FIG. 8) for stirring the colorant fluid in the fluid container 2. A stir member (45 of FIG. 8) is located in each fluid container 2. The stir members are rotatable around a rotation axis (46 of FIG. 8). The stir means 44 comprises rotation drives 52 for rotating the stir members 45 around the rotation axis. The stir member 45 of each fluid container 2 is driven by a different rotation drive 52. The stir means 44 further comprises a stir control (77 of FIG. 1) for controlling the rotation speed of each stir member 45. The stir means 44 further comprise sensor means for determining the level of colorant fluid in each of the fluid containers. The stir control 77 communicates with said sensor means. In this embodiment the stir control 77 is integrated with the control means 38 mentioned in relation with FIG. 1. The control means 38, and thus also the stir control 77, are in communication with the rotation drives 52.

Figure 3:
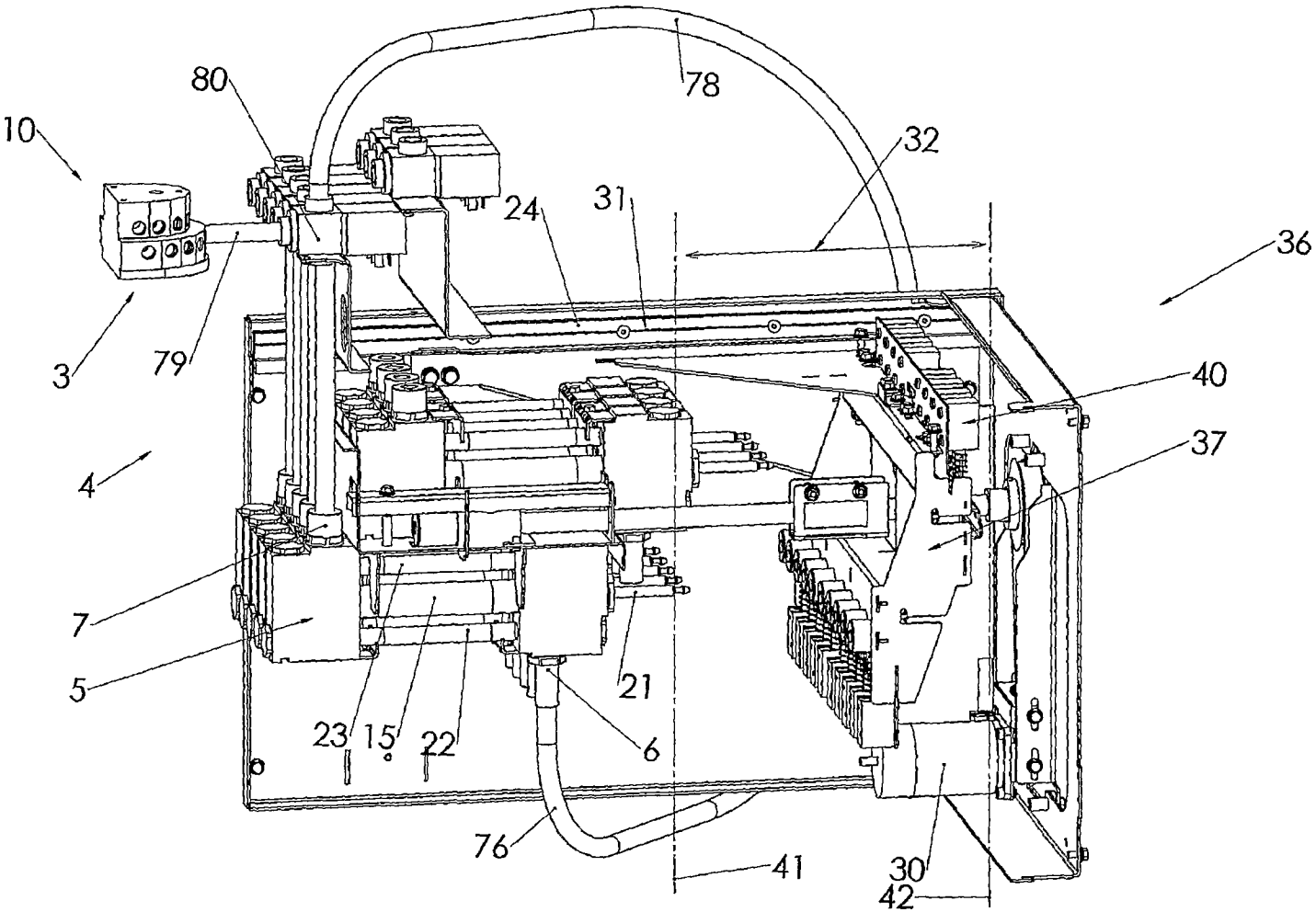

FIG. 3 shows the pumping means and the driving means of the colorant fluid dispensing device of FIG. 1 in an enlarged view. Each double acting piston pumps 5 comprises a central pump tube 15 in which a piston (20 of FIG. 4) is provided and a substantially parallel to the central pump tube 15 extending first duct 22 and second duct 23. The piston 20 is connected to a piston rod 21 for moving the piston 20 inside the central pump tube 15. Each double acting piston pump 5 further comprises a pump inlet 6 for letting in the colorant fluid from the thereto connected fluid container 2 and a pump outlet 7 for letting out the colorant fluid towards the thereto connected dispenser outlet 3.

The driving means 36 comprises a selector drive 30 for driving the selector 37. The selector 37 is movable arranged along a selector trajectory 31 to and away from the double acting piston pumps 5. The movement of the selector 37 in said directions is indicated by arrow 32. The selector trajectory 31 is formed by a pair of rails 24. The selector drive 30 is in communication with the control means 38 for controlling the selector drive 30. In stead of controlling the selector drive 30 with the control means 38, a separate selector control may be provided.

The input means 39 are configured for providing a first input to the control means 38, which first input indicates a selection of at least one piston rod 21 of the double acting piston pumps 5. The movable selector 37 is configured to engage the at least one piston rod 21 of the selection such that the at least one piston rod 21 of the selection is movable along with the selector 37 without moving the piston rods 21 not part of the selection.

The selector 37 comprises engage means 40 configured to engage or disengage a piston rod 21 such that engaged piston rods 21 are movable by the selector 37 without moving disengaged piston rods 21. The control means 38 is configured to control the engage means 40 such that the engage means 40 engage the piston rods 21 of the selection and disengage the piston rods 21 not part of the selection.

The selector 37 is movable along the selector trajectory 31 from a start position 41 to an end position 42. The control means 38 is configured to change the engagement and disengagement of the engage means 40 only when the selector 37 is positioned in the start position 41.

The input means 39 is further configured to provide a second input to the control means 38. The second input indicates a quantity of colorant fluid to be dispensed by each of the double acting piston pumps 5 of the selection and out of the dispenser outlets 3. The control means 38 is configured to control the selector drive 30 such that the selector 37 is moved from the start position 41 to a return position located on the selector trajectory 31 and back to the start position 41.

The return position is located between the start position 41 and end position 42 or at the end position 42. The return position is determined by the largest displacement of the piston rods 21 of the selection required for dispensing the indicated quantity of colorant fluid. More specifically, the return position is chosen such that the displacement of the selector 37 from the start position 41 to the return position and back to the start position 41 equals the largest displacement of the piston rods 21 of the selection required for dispensing the indicated quantity of colorant fluid.

Each double acting piston pump 5 comprises a first fluid connection 76 with a fluid container 2. Each of the pump outlets 7 is connected to a disperser outlet 3 via a second fluid connection 79. Said second fluid connections 79 comprises a three-way valve 80 which via a third fluid connection 78 is connected with the fluid container 2 being connected to the corresponding double acting piston pump 5. The control means 38 are configured to control the three-way valves 80 during the movement of the selector 37 along the selector trajectory 31 such that from the colorant fluids pumped by the double acting piston pumps 5 of the selection the indicated quantity of each colorant fluid is dispensed out of the dispenser outlets 3 and the additional pumped colorant fluid is returned to the fluid containers 2.

In use, a user may use the keyboard 70 and display 71 of the input means 39 to indicate a wished colour of paint and to supply the control means 38 with further relevant data like the quantity and colour of the paint in the fluid holder placed under the dispenser outlets 3 and on the fluid holder support 66. The fluid containers 2 contain different colorant fluids. The control means 38 subsequently determine the first input and the second input, after which the dispensing process is started. A selection of the piston rods 21 required for the wished colour is engaged by selector 37. In practice it is always required that several colorant fluids are dispensed to obtain the wished colour. This means that a selection of multiple piston rods 21 is engaged by the selector 37. The selector 37 moves the piston rods 21 of said selection from the start position 41 to the return position and back to the start position 41. This means that the selector 37 moves the piston rods 21 simultaneously. During the movements in both directions 32 the double acting piston pumps 5 of the selection pump the colorant fluids out of the pump outlets 7 thereof. The three-way valves ensure that from each of the colorant fluids pumped out of the pump outlets 7, the quantity required for the wished colour is dispensed out of the dispensing outlets 3. The additional pumped colorant fluids are directed back to the fluid container 2 from which they were removed by the double acting piston pumps 5. After this, the cycle can be repeated for a further fluid holder. This way, the colorant fluid dispensing device can be used to produce paint of every colour. Each colour is produced by its own specific formula.

The control means 38 comprise time measuring means and is configured to activate the pumping means 4 such that a small quantity of colorant fluid is dispensed out of one of the dispenser outlets 3 when said dispenser outlet 3 has not dispensed a colorant fluid for a predetermined time period. Each double acting piston pump 5 is connected to a different dispenser outlet 3. The control means are configured to activate one of the double acting piston pump 5 when said pump 5 is not activated for a predetermined time period such that colorant fluid is dispensed out of the dispenser outlet 3 in fluid connection with said pump. Said predetermined time period may be 5 hours. The small quantity may be between 0.1 and 0.2 milliliter.

Figure 4:
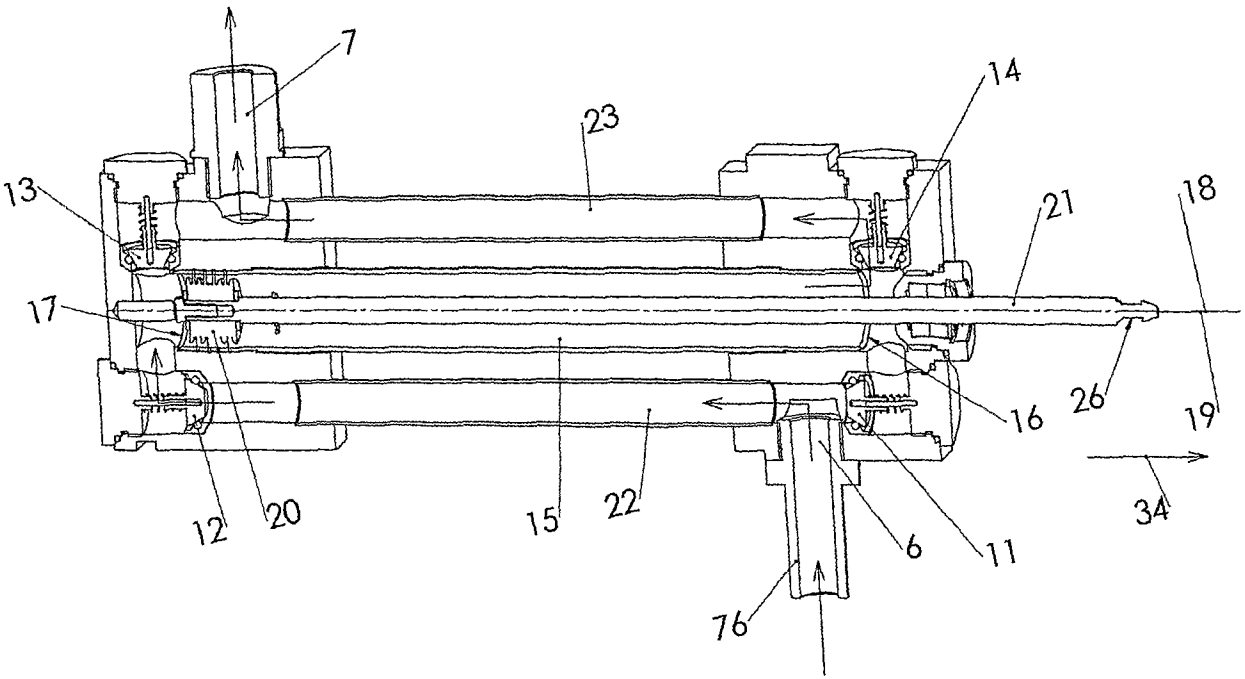
Figure 5:
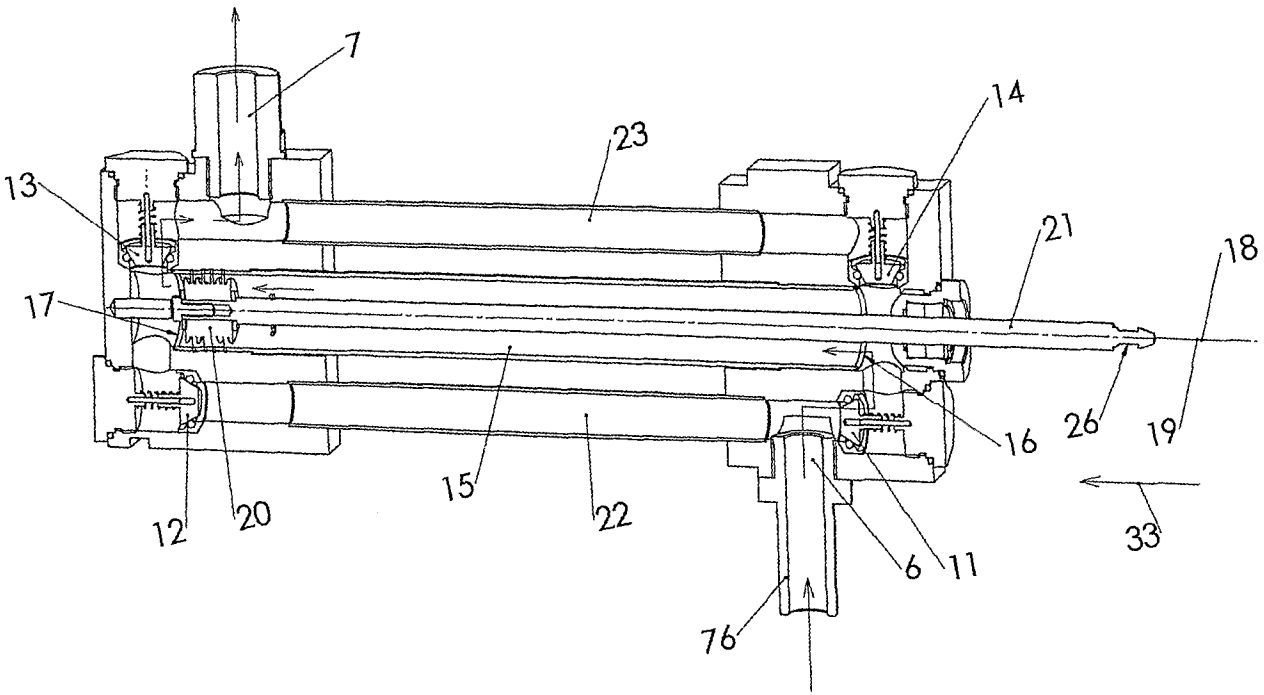

FIGS. 4 and 5 show a cross sectional view of the double acting piston pump of the colorant fluid dispensing device of FIG. 1. The double acting piston pumps 5 comprise a central pump tube 15, a first duct 22 and a second duct 23. The central pump tube 15 comprises a first tube end 16 and a second tube end 17. The piston 20 located inside the central pump tube 15 is movable between the first and second tube end 16, 17.

The first duct 22 is at an end thereof connected to the central pump tube 15 via a first valve 11 and at an other end thereof connected to the central pump tube 15 via a second valve 12. The second duct 23 is at an end thereof connected to the central pump tube via a third valve 13 and at an other end thereof connected to the central pump tube 15 via a fourth valve 14. The pump inlet 6 is in fluid connection with the first duct 22 and the pump outlet 7 is in fluid connection with the second duct 23.

The double acting piston pump 5 is configured such that for pumping the colorant fluid out of the pump outlet 7 the first valve 11 and the third valve 13 are closed and the second valve 12 and fourth valve 14 are open when the piston is moved towards the first end 16 of the central pump tube 15. The first valve 11 and the third valve 13 are open and the second valve 12 and fourth valve 14 are closed when the piston 20 is moved towards the second end 17 of the central pump tube 15 to pump colorant fluid out of the pump outlet 7. FIG. 4 shows the situation in which the piston is moved towards the first end 16. The direction of movement of the piston 20 is indicated by arrow 34. The piston rod 21 is moved out of the central pump tube 15. FIG. 5 shows the situation in which the piston is moved towards the second end 17. The direction of movement of the piston 20 is indicated by arrow 33. The piston rod 21 is moved in the central pump tube 15. The flow direction of the colorant fluid during pumping is in the FIGS. 4 and 5 indicated by arrows. The piston rod 21 comprises a notch 26 to facilitate the moving of the piston rod 21.

The central pump tube 15 comprises a first cross sectional area extending substantially perpendicular to the longitudinal axis 18 of the central pump tube 15. The part of the piston rod 21 in use extending through the inside of the central pump tube 15 comprises a second cross sectional area extending substantially perpendicular to the longitudinal axis 19 of the piston rod 21. The second cross sectional area is 0.15 times the first cross sectional area. Due to this, 15% less colorant fluid is pumped out of the pump outlet 7 when the piston rod 21 is moved out of the central pump tube 15 (see FIG. 4) than when the piston rod 21 is moved in the central pump tube 15 (see FIG. 5).

The base frame 8 is configured for positioning the colorant fluid dispensing device 1 in a use position on a surface 9. Said use position is shown in FIGS. 1 and 2. In the use position the pump outlet 7 of the double acting piston pump 5 is located at a larger distance from the surface 9 than the pump inlet 6. The pump inlet 6 and pump outlet 7 are positioned such that in the use position a plane extending through the pump inlet 6 and the pump outlet 7 extends substantially perpendicular to the surface 9. In the use position the central pump tube 15, the first duct 22 and the second duct extend substantial parallel to the surface 9. In the use position the second duct 23 is located at a larger distance for the surface 9 than the first duct 22. The central pump tube 15, first duct 22 and second duct 23 extend substantially parallel to each other.

Figure 6:
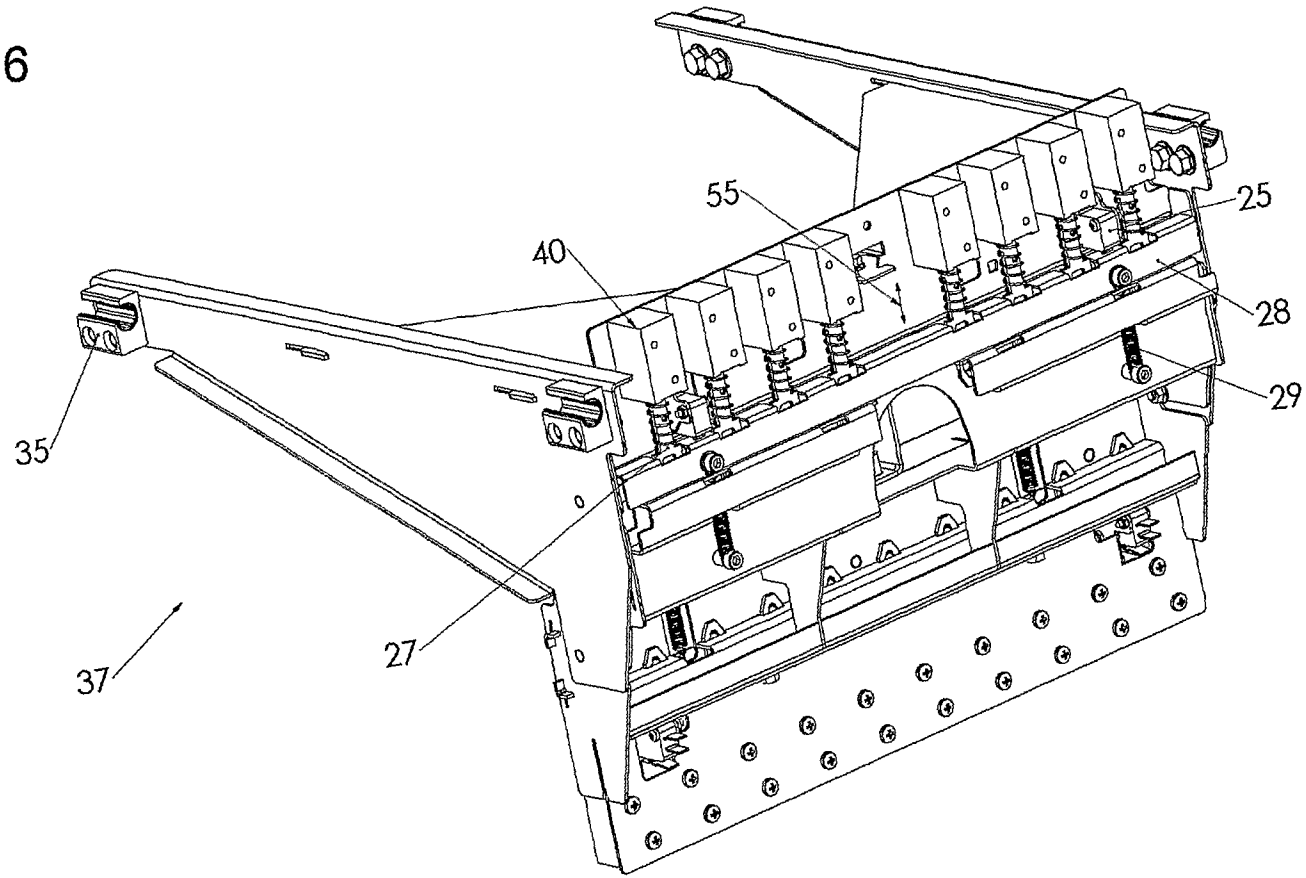
Figure 7:
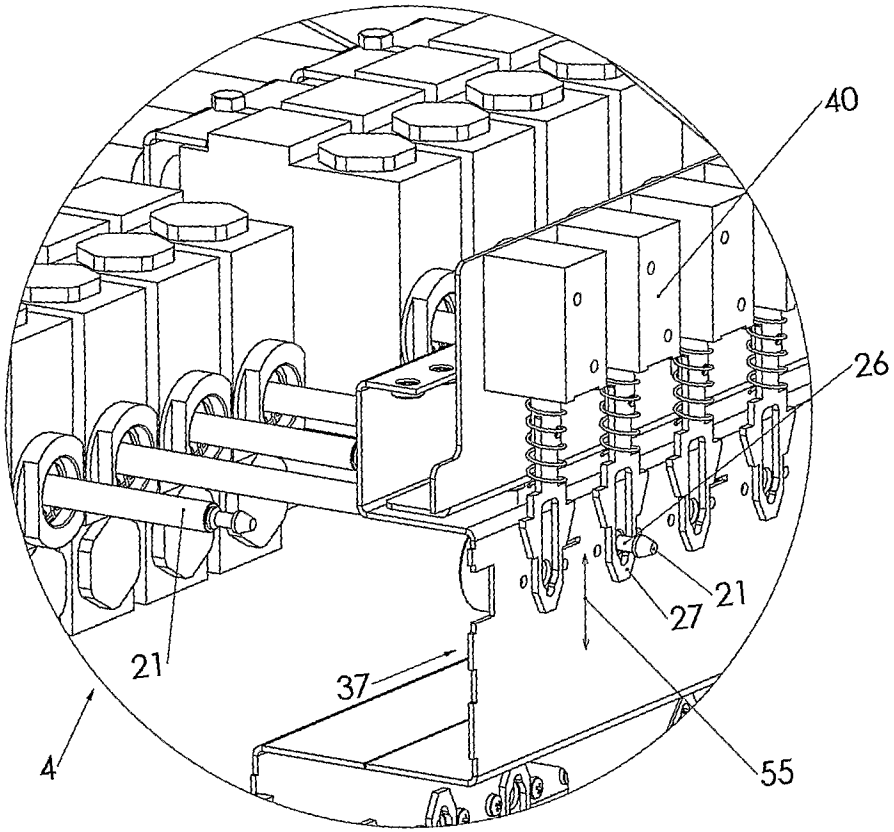

FIG. 6 shows the movable selector of the colorant fluid dispensing device of FIG. 1 and FIG. 7 shows in an enlarged view part of the engaging means of said colorant fluid dispensing device. The selector 37 comprises guiding means 35 for guiding along the rails 24. The engage means 40 comprises engage members 27 for engaging a piston rod 21 at the notch 26. Engage sensors 25 are provided for checking for failures during the engaging and disengaging of the engage members 27 on the piston rod 21. The engage sensors 25 are in communication with the control means 38. If a failure is detected by one of the engage sensors 25, a warning is shown on the display 71.

The engage sensors 25 are configured to detect the movement of a failure beam 28 provided under a set of engage members 27. In the start position 41 the piston rods 21 are located between an engage member 27 and a failure beam 28. For engaging, the engage members 27 are moved in the notch 26 of the piston rods 21. For disengaging, the engage members 7 are remove from the notch 26 of the piston rod 21. The directions of said movements are indicated by arrow 55.

When during the dispensing something has gone wrong with the engagement of an engage member 27 to a piston rod 21, said piston rod 21 will not be positioned between the engage member 27 and the failure beam 28 when the selector 37 is positioned in the start position 41. If in this situation the engage member 27 is moved to engage said piston rod 21 not present, the engage member 27 will collide with the failure beam 28 causing a movement of said failure beam 28. The engage sensor 25 detects said movement of the failure beam 28 and communicates this to the control means 28. When the engage member 27 is removed, the failure beam 28 is moved in its original position by beam positioning means 29 comprising a spring.

Figure 8:
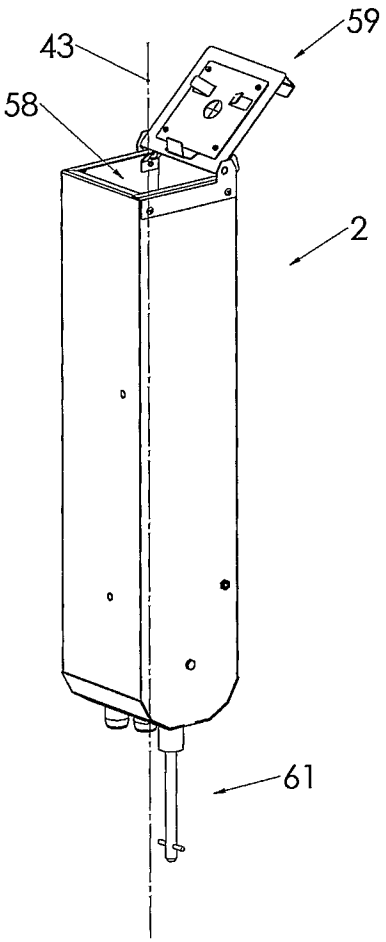

FIG. 8 shows the fluid container of the colorant fluid dispensing device of FIG. 1 in a perspective view. The fluid container 2 comprises a longitudinal axis 43, an inlet opening 58, a container lid 59 and a drive member 61.

Figure 9:
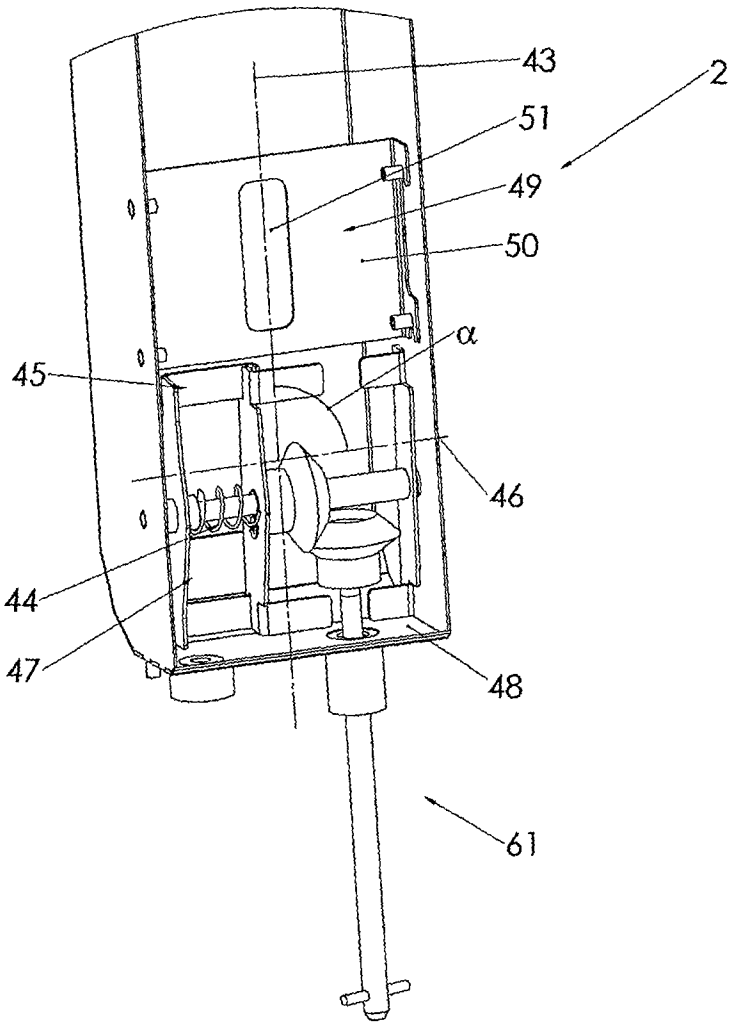

FIG. 9 schematically shows a cross sectional view of part of the fluid container of FIG. 8 and the stir means 44 thereof, Each fluid container 2 comprises stir means 44 for stirring the colorant fluid in the fluid container 2. A stir member 45 is located at the inside of the fluid container 2. The stir member 45 is positioned in the lower part 47 of the fluid container 2. The stir member 45 is rotatable around a rotation axis 46. When rotated, the stir member 45 moves adjacent to the bottom 48 of the fluid container 2. The stir means 44 comprise a drive member 61 for driving the stir member 45 such that it rotates around the rotation axis 46. The drive member 61 is connected to the rotation drive 52. The rotation axis 46 extend relative to the longitudinal axis 43 under an angle. A fluid guide 49 is provided in the fluid container 2. The fluid guide 49 comprises a plate like body 50 with an opening 51.

Figure 10:
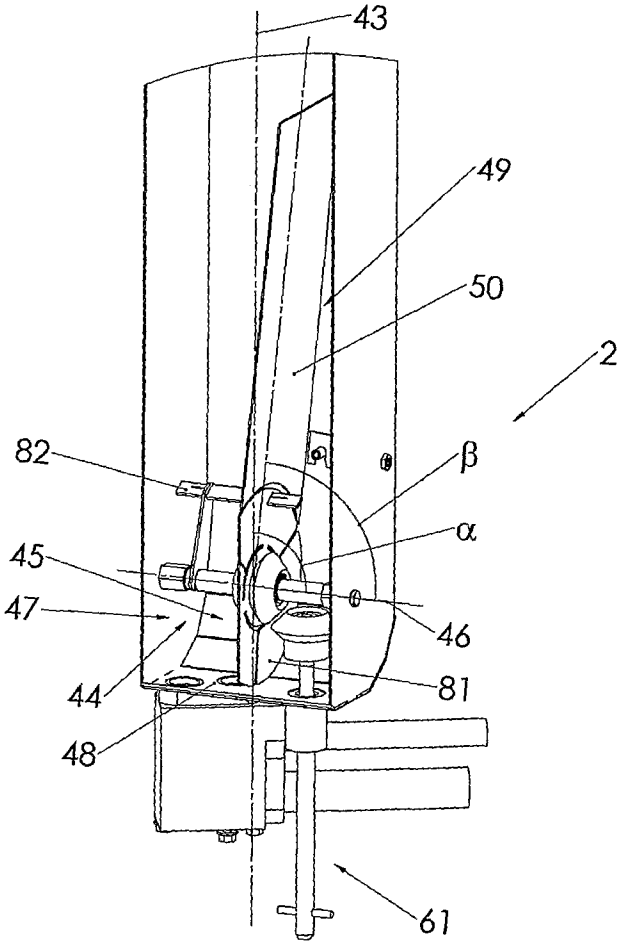

FIG. 10 schematically shows a cross sectional view of a further embodiment of the fluid container and the stir means thereof, The stir member 45 comprises a propeller like form 81. The plate like body 50 of the fluid guide 49 extends relative to the rotation axis under an angle. A bottom stir element 81 is provided, which in use moves adjacent to the bottom 48 of the fluid container.

Figure 11:
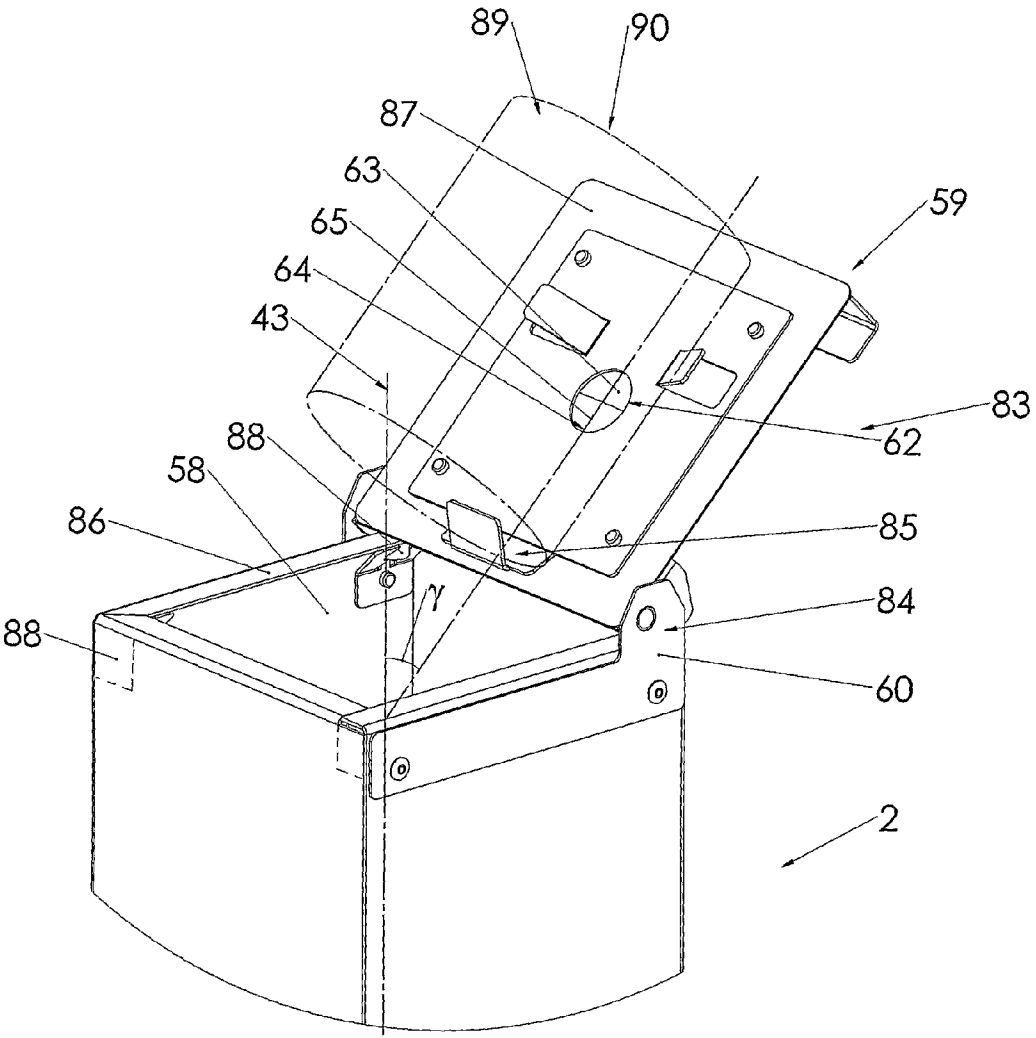

FIG. 11 shows the fluid container of the colorant fluid dispensing device of FIG. 1 and the container lid thereof, The fluid container 2 comprises an inlet opening 58 for letting in the colorant fluid to fill said fluid container 2. A container lid 59 for closing said filing opening 58 is provided. The container lid 59 comprises a lid opening 62 sealed by a pressure valve 64 formed by a flexible member 63 in the form of a plate and comprising a cross like incision 65.

The inlet opening 58 is surrounded by a first flat closing surface 86 and the container lid 59 comprises a second flat closing surface 87 configured to be positioned on the first closing surface 86 such that the container lid 59 closes the inlet opening 58. Retention means in the form of magnets 88 are provided under the first closing surface 88. Said magnets 88 retain the container lid 59 in the position wherein the first closing surface 86 is located on the second closing surface 87. Magnets may also be provided in the container lid 59, this in addition to or in stead of the magnets 88 shown.

The fluid container 2 comprises lid connection means 60 for connecting the container lid 59 to the fluid container 2. The lid connection means 60 are configured to position the container lid 59 in a shielding position 83 to block splashes of colorant fluid during the filling of the fluid container 2. The container lid 59 is connected to the fluid container 2 such that the container lid 59 is movable between a closing position in which the container lid 59 closes the fluid container 2 (second closing surface 87 positioned on the first closing surface 86) and the shielding position 83 while being connected to the fluid container 2. This is achieved by the lid hinge 84.

The lid connection means 60 are configured to position the container lid 59 such that the container lid 59 in the shielding position 83 extends under a lid angle relative to the longitudinal axis 43 of the fluid container 2.

The container lid 59 comprises holding means 85 for in use holding a colorant fluid holder 89, such as a colorant fluid can, in a filling position 90 such that the colorant fluid of the colorant fluid holder 89 flows in the inlet opening of the fluid container. In said filling position the gravity drives the colorant fluid out of the colorant fluid holder 89 and into the inlet opening 58 of the fluid container 2.

Figure 12:
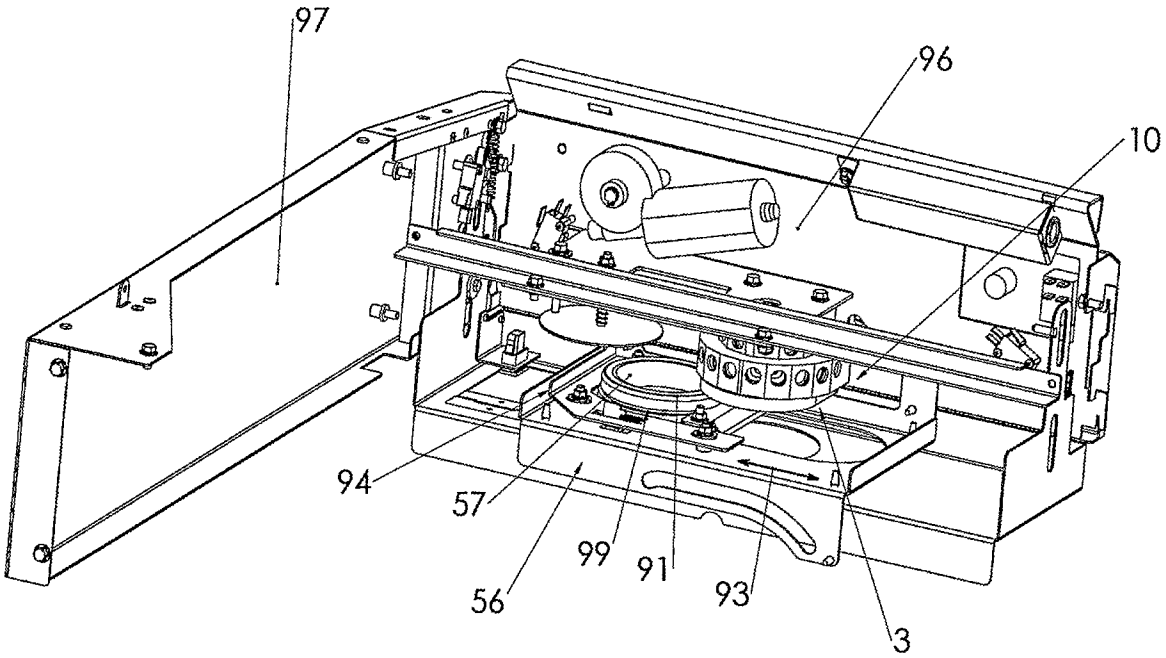
Figure 13:
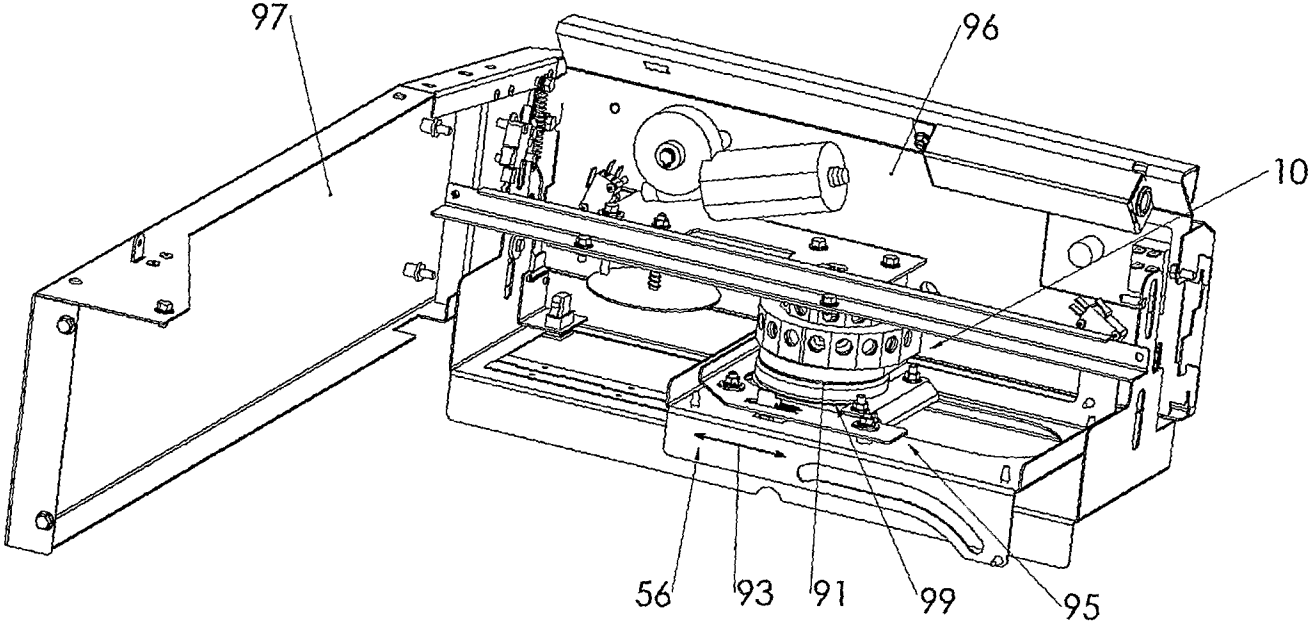

FIGS. 12 and 13 show the sealing means of the colorant fluid dispensing device of FIG. 1. The sealing means 56 is located inside the colorant fluid dispensing device 1. It will be clear that the sealing means 56 may have any other form, like a sealing means located outside the colorant fluid dispensing device 1 or a sealing means which is a separate item and is connectable to and disconnectable from the colorant fluid dispensing device 1.

The sealing means 56 is configured to enclose the dispenser outlets 3 such that said dispenser outlets 3 are located in a substantially closed space. The sealing means 56 enclose the dispenser outlets 3 such that said dispenser outlets 3 are located in a substantially gas tight closed space. The sealing means 56 comprise receiving means 57 for receiving and holding said by the dispenser outlet dispensed small quantities of colorant fluid.

The sealing means 56 comprise a sealing member 99 and the receiving means 57 are provided on the sealing member 99. The sealing means 56 are configured to move the sealing member 99 between a first member position 94 in which the receiving means 57 do not receive colorant fluid dispensed by the dispenser outlets and a second member position 95 in which the receiving means 57 receive colorant fluid dispensed by the dispenser outlets 3. The control means 38 are configured to move the seal member 99 into the second member position 95 when one of the dispenser outlets 3 dispenses said small quantity of colorant fluid. The movement of the sealing member 99 is indicated by arrow 93.

The sealing member 99 comprises sealing rim 91 configured to contact the dispenser member 10 such that the dispenser outlets 3 are located in a substantially gas tight closed space. The dispenser member 10 comprises a total of 24 dispenser outlets 3. The receiving means 57 are configured to hold between 72 milliliter (24 times 3 milliliter) and 96 milliliter (24 times 4 milliliter). Said capacity of the receiving means 57 allows to receive such an amount of colorant fluid which can cover a weekend of downtime of the colorant fluid dispensing device 1.

Figure 14:
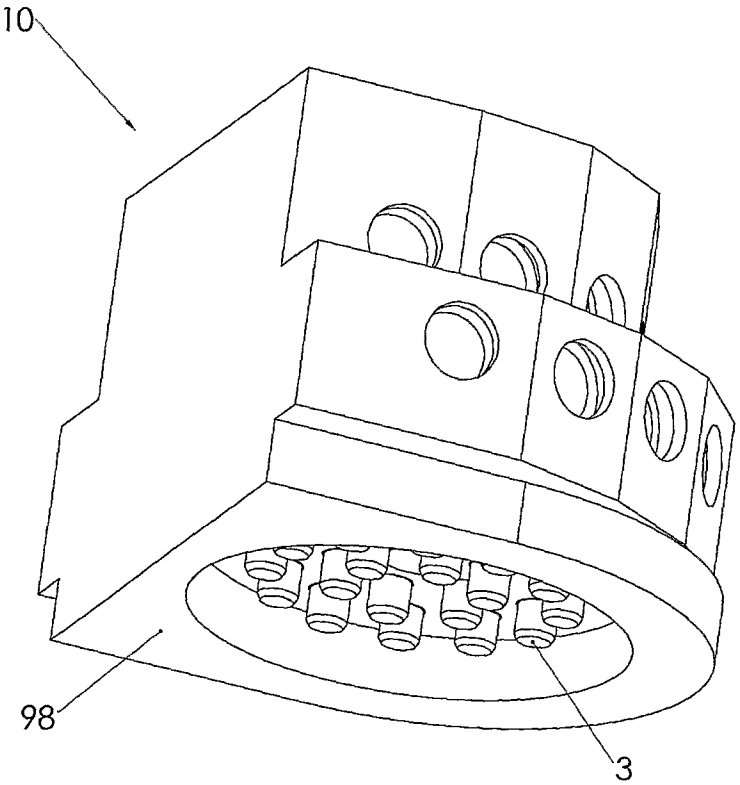
FIG. 14 shows a perspective view of the dispenser member of the colorant fluid dispensing device of FIG. 1.

FIG. 14 shows the dispenser member 10 of the colorant fluid dispensing device 1 of FIG. 1. The dispenser outlets 3 are surrounded by a lower dispenser surface 98. In the second member position 95, the sealing rim 91 of the sealing member 99 is positioned on said lower dispenser surface 98 such that the dispenser outlets 3 are located in a substantially gas tight closed space.

The invention further relates to any of the following clauses.

1. Colorant fluid dispensing device (1) for dispensing multiple colorant fluids, said colorant fluid dispensing device comprising
more than one fluid container (2) for containing a colorant fluid,
at least one dispenser outlet (3) for dispensing the colorant fluids of the fluid containers, wherein
the fluid containers are in fluid connection with the at least one dispenser outlet via pumping means (4) for pumping said colorant fluids of the fluid containers out of the at least one dispenser outlet,
the pumping means comprises at least one piston pump, and said piston pump is a double acting piston pump (5).

2. Colorant fluid dispensing device according to clause 1, wherein the double acting piston pump is connected to one of the fluid containers via a first fluid connection (76) and to one of the dispenser outlets via a second fluid connection (79), and the second fluid connection (79) comprises a three-way valve (80) which via a third fluid connection (78) is connected to the fluid container being connected to said double acting piston pump via said first fluid connection (76).

3. Colorant fluid dispensing device according to clause 1 or 2, wherein the double acting piston pump comprises a pump inlet for letting in the colorant fluid and a pump outlet for letting out the colorant fluid.

4. Colorant fluid dispensing device according to clause 3, wherein
the double acting piston pump comprises a central pump tube and a piston movable arranged in the central pump tube,
the central pump tube comprises a first tube end and a second tube end,
the double acting piston pump is configured to pump colorant fluid out of the pump outlet when the piston is moved towards the first tube end and to pump colorant fluid out of the pump outlet when the piston is moved towards the second tube end.

5. Colorant fluid dispensing device according to any of the preceding clauses, wherein
the colorant fluid dispensing device comprises a base frame (8) for positioning the colorant fluid dispensing device in a use position on a surface (9).

6. Colorant fluid dispensing device according to clause 5, wherein in said use position the pump outlet of the double acting piston pump is located at a larger distance from said surface than the pump inlet thereof.

7. Colorant fluid dispensing device according to clause 5 or 6 in combination with clause 3, wherein the pump inlet and the pump outlet of the double acting piston pump are positioned such that in the use position a plane extending through the pump inlet and the pump outlet extends substantially perpendicular to said surface.

8. Colorant fluid dispensing device according to any of the clauses 4-7, wherein
the double acting piston pump comprises
a first duct (22) which is
near or at an end thereof connected to the central pump tube via a first valve (11) and near or at an other end thereof connected to the central pump tube via a second valve (12),
a second duct (23) which is
near or at an end thereof connected to the central pump tube via a third valve (13) and near or at an other end thereof connected to the central pump tube via a fourth valve (14),
the pump inlet is in fluid connection with the first duct, and
the pump outlet is in fluid connection with the second duct.

9. Colorant fluid dispensing device according any of the clauses 5-8 in combination with clause 4, wherein in the use position the central pump tube extends substantial parallel to said surface.

10. Colorant fluid dispensing device according to clause 8 or 9 in combination with clause 5, wherein in the use position the second duct is located at a larger distance for the surface than the first duct.

11. Colorant fluid dispensing device according to any of the clauses 8-10 in combination with clause 4, wherein the central pump tube, first duct and second duct extend substantially parallel to each other.

12. Colorant fluid dispensing device according to any of the clauses 8-11, wherein the first duct and the second duct are substantially of the same length.

13. Colorant fluid dispensing device according to any of the clauses 8-12 in combination with clause 4, wherein
the double acting piston pump comprises a piston rod (21) connected to the piston for moving the piston inside the central pump tube,
the inside of the central pump tube comprise a first cross sectional area extending substantially perpendicular to a longitudinal axis of the central pump tube,
the piston rod in use extends at least partly through the inside of the central pump tube,
the part of the piston rod in use extending through the inside of the central pump tube comprises a second cross sectional area extending substantially perpendicular to a longitudinal axis of the piston rod,
the size of the second cross sectional area is between 0.02 and 0.2 times the size of the first cross sectional area.

14. Colorant fluid dispensing device according to any of the clauses 8-13 in combination with clause 4, wherein
the central pump tube comprises a first end (16) and a second end (17),
the first valve (11) and the fourth valve (14) are located near or at said first end of the central pump tube,
the second valve (12) and the third valve (13) are located near or at said second end of the central pump tube.

15. Colorant fluid dispensing device according to clause 14, wherein the double acting piston pump is configured such that for pumping the colorant fluid out of the pump outlet
the first valve and the third valve are closed and the second valve and fourth valve are open when the piston is moved towards said first end of the central pump tube, and
the first valve and the third valve are open and the second valve and fourth valve are closed when the piston is moved towards said second end of the central pump tube.

16. Colorant fluid dispensing device according to clause 14 or 15, wherein the double acting piston pump is configured
to move the piston towards the first end of the central pump tube by moving the piston rod out of the central pump tube and
to move the piston towards the second end of the central pump tube by moving the piston rod in the central pump tube.

17. Colorant fluid dispensing device according to any of the clauses 3-16, wherein
the double acting piston pump comprises a second inlet and a second outlet,
the first inlet is in fluid connection with a first fluid container, the second inlet is in fluid connection with a second fluid container, the double acting piston pump is configured to pump a first colorant fluid from the first fluid container out of the first pump outlet and to pump a second colorant fluid from the second fluid container out of the second pump outlet.

18. Colorant fluid dispensing device according to clause 17, wherein the double acting piston pump is configured such that in use the first colorant fluid and the second colorant fluid during the pumping out of the first pump outlet and/or the second pump outlet remain separated from each other.

19. Colorant fluid dispensing device for dispensing multiple colorant fluids, said colorant fluid dispensing device comprising more than one fluid container for containing a colorant fluid, at least one dispenser outlet for dispensing the colorant fluids of the fluid containers, wherein the fluid containers are in fluid connection with the at least one dispenser outlet via pumping means for pumping said colorant fluids of the fluid containers out of the at least one dispenser outlet, the pumping means comprises more than one piston pump, each piston pump comprises a central pump tube (15) in which a piston (20) is provided, the piston being connected to a piston rod (21) for moving the piston inside the central pump tube, the colorant fluid dispensing device further comprises driving means for moving the piston rods of said piston pumps, control means for controlling the driving means, and input means for providing a first input to the control means, which first input indicates a selection of at least one piston rod, and the driving means comprises a movable selector configured to engage the at least one piston rod of the selection such that the at least one piston rod of the selection is movable along with the selector without moving the piston rods not part of the selection.

20. Colorant fluid dispensing device according to clause 19, wherein the selector comprises engage means configured to engage or disengage at least one of the piston rods such that engaged piston rods are movable by the selector without moving disengaged piston rods, and the control means is configured to control the engage means such that the engage means engage the piston rods of the selection and disengage the piston rods not part of the selection.

21. Colorant fluid dispensing device according to clause 19 or 20, wherein the selector is movable along a selector trajectory from a start position to an end position and the control means is configured to change the engagement and disengagement of the engage means on the piston rods only when the selector is positioned in the start position.

22. Colorant fluid dispensing device according to clause 21, wherein the piston pumps are double acting piston pumps, the input means is configured to provide a second input to the control means, which second input indicates a quantity of colorant fluid to be dispensed by each of the double acting piston pumps of said selection and out of the at least one dispenser outlet, the control means is configured to control the drive means such that the selector is moved from the start position to a return position located on the selector trajectory and back to the start position, said return position being determined by the largest displacement of the piston rods of the selection required for dispensing the by the second input indicated quantity of colorant fluid.

23. Colorant fluid dispensing device according to clause 22, wherein said return position is chosen such that the displacement of the selector from the start position to the return position and back to the start position equals the largest displacement of the piston rods of the selection required for dispensing the by the second input indicated quantity of colorant fluid.

24. Colorant fluid dispensing device according to clause 22, wherein said return position is chosen such that the displacement of the selector from the start position to the return position and back to the start position equals between the 1.05 and 1.15 times the largest displacement of the piston rods of said selection required for dispensing the by the second input indicated quantity of colorant fluid.

25. Colorant fluid dispensing device according to clause 24, wherein between 5% and 15% of the movement of the selector along the trajectory is used to build up a pressure in the colorant fluids in the double acting piston pumps of the selection.

26. Colorant fluid dispensing device according to any of the clauses 22-25, wherein each double acting piston pump is connected to one of the fluid containers via a first fluid connection (76) and to one of the dispenser outlets via a second fluid connection (79), each of said second fluid connections (79) comprises a three-way valve (80) which via a third fluid connection (78) is connected to the fluid container being connected to said double acting piston pump via said first fluid connection (76) and the control means are configured to control the three-way valves during the movement of the selector along the selector trajectory such that from the colorant fluids pumped by the double acting piston pumps of the selection the by the second input indicated quantity of each colorant fluid is dispensed out of the at least one dispenser outlet and the additional pumped colorant fluid is returned to the fluid container.

27. Colorant fluid dispensing device for dispensing multiple colorant fluids, said colorant fluid dispensing device comprising more than one fluid container for containing a colorant fluid, at least one dispenser outlet for dispensing the colorant fluids of the fluid containers, wherein the fluid containers are in fluid connection with the at least one dispenser outlet via pumping means for pumping said colorant fluids of the fluid containers out of the at least one dispenser outlet, each fluid container comprises a longitudinal axis and stir means for stirring the colorant fluid in the container, the stir means comprises a stir member which is located inside the fluid container and is rotatable around a rotation axis, and the rotation axis extends traverse to the longitudinal axis of the fluid container.

28. Colorant fluid dispensing device according to clause 27, wherein the rotation axis extends under a rotation angle of between 450-1350, preferably between 800-1000, relative to the longitudinal axis of the fluid container.

29. Colorant fluid dispensing device according to clause 27 or 28, wherein the rotation axis extends substantially perpendicular relative to the longitudinal axis of the fluid container.

30. Colorant fluid dispensing device according to any of the clauses 27-29, wherein each fluid container comprises a lower part and the stir member is located in said lower part.

31. Colorant fluid dispensing device according to any of the clauses 27-30, wherein each fluid container comprises a bottom, a fluid guide is provided inside each the fluid container, and the stir member is located between said bottom and fluid guide.

32. Colorant fluid dispensing device according to 31, wherein the fluid guide comprises a plate like body extending substantially parallel to the longitudinal axis of the fluid container.

33. Colorant fluid dispensing device according to clause 32, wherein the fluid guide extends through the longitudinal axis of the fluid container.

34. Colorant fluid dispensing device according to any of the clauses 27-33, wherein each fluid container comprises a bottom and the stir member is located adjacent to the bottom.

35. Colorant fluid dispensing device according to any of the clauses 27-34, wherein each stir member comprises a bottom stir element and the stir member is configured to move the bottom stir element in the proximity of the bottom.

36. Colorant fluid dispensing device according to any of the clauses 31-35, wherein the bottom comprises a concave like form.

37. Colorant fluid dispensing device according to clause 36, wherein the stir member is configured such that the form thereof corresponds to the form of the bottom.

38. Colorant fluid dispensing device according to any of the clauses 27-37, wherein the stir means comprise a rotation drive for rotating the stir members around the rotation axis.

39. Colorant fluid dispensing device according to clause 38, wherein the stir member of each fluid container is driven by a different rotation drive and the stir means comprises a stir control for controlling the rotation speed of each stir member, a sensor means for determining a level of colorant fluid in each of the fluid containers, wherein the stir control is configured to adjust the rotation speed of each stir member to the level of colorant fluid of the corresponding fluid container.

40. Colorant fluid dispensing device according to clause 38, wherein the stir members of more than one fluid container are driven by one rotation drive and the stir means comprise a stir control for controlling the rotation speed of the stir members of the fluid containers driven by said one rotation drive, a sensor means for determining the level of colorant fluid in each of the fluid containers, wherein the stir control is configured to adjust the rotation speed of the stir members of the fluid containers driven by said one rotation drive to the lowest level of colorant fluid in the fluid containers driven by said rotation drive or the average level of colorant fluid in the fluid containers driven by said rotation drive.

41. Colorant fluid dispensing device according to any of the clauses 27-40, wherein the stir member comprises blades for moving colorant fluid in a direction along the rotation axis.

42. Colorant fluid dispensing device according to any of the clause 31-41, wherein the fluid guide extends substantially perpendicular to the rotation axis.

43. Colorant fluid dispensing device according to any of the clause 31-41, wherein the fluid guide extends under an angle of between 600-900, preferably between 700-850, relative to the rotation axis.

44. Colorant fluid dispensing device for dispensing multiple colorant fluids, said colorant fluid dispensing device comprising more than one fluid container for containing a colorant fluid, more than one dispenser outlet for dispensing the colorant fluids of the fluid containers, wherein the fluid containers are in fluid connection with the dispenser outlets via pumping means for pumping said colorant fluids of the fluid containers out of the dispenser outlets, the pumping means comprises more than one pump, the colorant fluid dispensing device comprises control means for controlling the pumping means, the control means comprises time measuring means and is configured to activate the pumping means such that a small quantity of colorant fluid is dispensed out of one of the dispenser outlets when said dispenser outlet has not dispensed a colorant fluid for a predetermined time period.

45. Colorant fluid dispensing device according to clause 44, wherein each pump is in fluid connection with a different dispenser outlet, the control means are configured to activate one of the pumps when said pump is not activated for the predetermined time period such that colorant fluid is dispensed out of the dispenser outlet in fluid connection with said pump.

46. Colorant fluid dispensing device according to clause 44 or 45, wherein said predetermined time period is between 2 and 8 hours, preferably between 4 and 6 hours, and the small quantity of colorant fluid is between 0.05 and 0.2 milliliter, preferably between 0.1 and 0.15 milliliter.

47. Colorant fluid dispensing device according to any of the clauses 44-46, wherein the colorant fluid dispensing device comprises a sealing means for sealing the dispenser outlets such that said dispenser outlets are located in a substantially closed space.

48. Colorant fluid dispensing device according to clause 47, wherein the sealing means seal the dispenser outlets such that said dispenser outlets are located in a substantially gas tight closed space.

49. Colorant fluid dispensing device according to clauses 47 or 48, wherein the sealing means comprises receiving means for receiving and holding said by the dispenser outlets dispensed small quantities of colorant fluids.

50. Colorant fluid dispensing device according to clause 49, wherein the colorant fluid dispensing device comprises a total of N dispenser outlets, and said receiving means is configured to hold between N times 2 milliliter and N times 5 milliliter, preferably N times 3 milliliter and N times 4 milliliter.

51. Colorant fluid dispensing device according to any of the clauses 44-50, wherein the more than one pumps are double acting piston pumps, each of the double acting piston pump is connected to one of the fluid containers via a first fluid connection (76) and to one of the dispenser outlets via a second fluid connection (79), and the second fluid connection (79) comprises a three-way valve (80) which via a third fluid connection (78) is connected to the fluid container being connected to said double acting piston pump via said first fluid connection (76).

52. Colorant fluid dispensing device according to any of the clauses 47-51, wherein the sealing means comprise a sealing member, the receiving means are provided on the sealing member, the sealing means are configured to move the sealing member between a first member position in which the receiving means do not receive colorant fluid dispensed by the dispenser outlets and a second member position in which the receiving means receive colorant fluid dispensed by the dispenser outlets.

53. Colorant fluid dispensing device according to clause 52, wherein the control means are configured to move the seal member into the second member position when one of the dispenser outlets dispenses said small quantity of colorant fluid.

54. Colorant fluid dispensing device for dispensing multiple colorant fluids, said colorant fluid dispensing device comprising more than one fluid container for containing a colorant fluid, at least one dispenser outlet for dispensing the colorant fluids of the fluid containers, wherein the fluid containers are in fluid connection with the at least one dispenser outlet via pumping means for pumping said colorant fluids from the fluid containers out of the at least one dispenser outlet, each fluid container comprises an inlet opening for letting in colorant fluid to fill the fluid container, a container lid for closing the inlet opening, and lid connection means for connecting the container lid to the fluid container, and the lid connection means are configured to position the container lid in a shielding position to block splashes of colorant fluid during the filling of the fluid container.

55. Colorant fluid dispensing device according to clause 54, wherein the lid connecting means are configured such that the container lid is movable between a closing position in which the container lid closes the fluid container and the shielding position while being connected to the fluid container.

56. Colorant fluid dispensing device according to clause 54 or 55, wherein the lid connection means are configured to position the container lid in the inlet opening such that the container lid in the shielding position extends out of the inlet opening.

57. Colorant fluid dispensing device according to any of the clauses 54-56, wherein each fluid container comprises a longitudinal axis and the lid connection means are configured to position the container lid such that the container lid in the shielding position extends traverse to the longitudinal axis of the fluid container.

58. Colorant fluid dispensing device according to clause 57, wherein the lid connection means are configured to position the container lid such that the container lid in the shielding position extends under a lid angle of between 00-600, preferably between 350-550, relative to the longitudinal axis of the fluid container.

59. Colorant fluid dispensing device according to any of the clauses 54-58, wherein the lid connection means are configured to position the container lid in a substantially upright position.

60. Colorant fluid dispensing device according to any of the clauses 54-59, wherein the container lid comprises holding means for in use holding a colorant fluid holder, such as a colorant fluid can, in a filling position such that the colorant fluid of the colorant fluid holder flows in the inlet opening of the fluid container.

61. Colorant fluid dispensing device according to clause 60, wherein the lid connection means and the holding means are configured to position the colorant fluid holder in the filling position such that position that gravity drives said colorant fluid out of the colorant fluid holder and into the inlet opening of the fluid container.

62. Colorant fluid dispensing device for dispensing multiple colorant fluids, said colorant fluid dispensing device comprising more than one fluid container for containing a colorant fluid, at least one dispenser outlet for dispensing the colorant fluids of the fluid containers, wherein the fluid containers are in fluid connection with the at least one dispenser outlet via pumping means for pumping said colorant fluids from the fluid containers out of the at least one dispenser outlet, each fluid container comprises an inlet opening for letting in colorant fluid to fill the fluid container and a container lid for closing said filing opening, the container lid comprises a lid opening sealed by a flexible member, and the flexible member comprises a pressure valve formed by an incision in said flexible member.

63. Colorant fluid dispensing device according to clause 62, wherein the flexible member substantially comprises the form of a plate.

64. Colorant fluid dispensing device according to clause 62 or 63, wherein the incision substantially comprises the form of a cross.

65. Colorant fluid dispensing device according to any of the clauses 62-64, wherein the inlet opening of each fluid container is surrounded by a first closing surface and the container lid comprises a second closing surface configured to be positioned on the first closing surface such that the container lid closes the inlet opening.

66. Colorant fluid dispensing device according to clause 65, wherein the first closing surface and the second closing surface are a flat surface.

67. Colorant fluid dispensing device according to clause 65 or 66, wherein the fluid container comprises retention means to retain the second closing surface on the first closure surface.

68. Colorant fluid dispensing device according to clause 66, wherein the retention means use a magnetic force to retain the second closing surface on the first closure surface.

69. Colorant fluid dispensing device comprising the features of the colorant fluid dispensing device according to any of the clauses 1-18 and/or, the colorant fluid dispensing device according to any of the clauses 19-26 and/or, the colorant fluid dispensing device according to any of the clauses 27-43 and/or, the colorant fluid dispensing device according to any of the clauses 44-51 and/or, the colorant fluid dispensing device according to any of the clauses 52-68.

70. Colorant fluid dispensing device comprising one feature or any combination of a number of the features of the colorant fluid dispensing devices according to any of the clauses 1-69.

71. Fluid container according to any of the clauses 1-70.

72. Fluid container for use in a colorant fluid dispensing device according to any of the clauses 1-70.

73. Use of a colorant fluid dispensing device according to any of the clauses 1-70.

74. Use of a fluid container according to clause 71 or 72.

75. Method for dispensing a colorant fluid with a colorant fluid dispensing device according to any of the clauses 1-70.

76. Method for filling a fluid container of a colorant fluid dispensing device according to any of the clauses 1-70.

77. Method for dispensing a colorant fluid with a colorant fluid dispensing device comprising more than one fluid container for containing a colorant fluid, at least one dispenser outlet for dispensing the colorant fluids of the fluid containers, wherein the fluid containers are in fluid connection with the at least one dispenser outlet via pumping means for pumping said colorant fluids of the fluid containers out of the at least one dispenser outlet, the pumping means comprises more than one piston pump, each piston pump comprises a central pump tube (15) in which a piston (20) is provided, the piston being connected to a piston rod (21) for moving the piston inside the central pump tube, the colorant fluid dispensing device further comprises driving means for moving the piston rods of said piston pumps, control means for controlling the driving means, and input means for providing a first input to the control means, which first input indicates a selection of at least one piston rod, and the driving means comprises a movable selector, said method comprising the step of engaging the at least one piston rod of the selection with the selector such that the at least one piston rod of the selection is movable along with the selector without moving the piston rods not part of the selection.

78. Method according to clause 77, comprising moving the selector such that the at least one piston rod of the selection is moved along with the selector without moving the piston rods not part of the selection.

79. Method for dispensing a colorant fluid with a colorant fluid dispensing device comprising more than one fluid container for containing a colorant fluid, more than one dispenser outlet for dispensing the colorant fluids of the fluid containers, wherein the fluid containers are in fluid connection with the dispenser outlets via pumping means for pumping said colorant fluids of the fluid containers out of the dispenser outlets, the pumping means comprises more than one pump, the colorant fluid dispensing device comprises control means for controlling the pumping means, said control means comprising time measuring means, said method comprising controlling the pumping means such that the pumping means are activated to dispense a small quantity of colorant fluid out of one of the dispenser outlets when said dispenser outlet has not dispensed a colorant fluid for a predetermined time period.

80. Method according to clause 79, wherein each pump is in fluid connection with a different dispenser outlet and the method comprises activating of one of the pumps when said pump is not activated for the predetermined time period such that colorant fluid is dispensed out of the dispenser outlet in fluid connection with said pump.

81. Method according to clause 79 or 80, comprising positioning a sealing means such that the out of the dispenser outlet dispensed colorant fluid is received by a receiving means of said sealing means.

82. Method according to clause 81, wherein the sealing means comprise a seal member on which the receiving means are provided and the method comprises moving of the sealing means between a first member position in which the receiving means do not receive colorant fluid dispensed by the dispenser outlets and a second member position in which the receiving means receive colorant fluid dispensed by the dispenser outlets.

83. Method according to clause 82, wherein the method comprises moving the seal member into the second member position when the dispenser outlets dispense said small quantity of colorant fluid.

The invention claimed is:

1. Colorant fluid dispensing device for dispensing multiple colorant fluids, said colorant fluid dispensing device comprising more than one fluid container for containing a colorant fluid, at least one dispenser outlet for dispensing the colorant fluids of the fluid containers, wherein the fluid containers are in fluid connection with the at least one dispenser outlet via pumping means for pumping said colorant fluids of the fluid containers out of the at least one dispenser outlet, the pumping means comprises more than one piston pump, each piston pump comprises a central pump tube in which a piston is provided, the piston being connected to a piston rod for moving the piston inside the central pump tube, the colorant fluid dispensing device further comprises driving means for moving the piston rods of said piston pumps, control means for controlling the driving means, and input means for providing a first input to the control means, which first input indicates a selection of multiple piston rods, the driving means comprises a movable selector configured to engage the piston rods of the selection such that the piston rods of the selection are simultaneously movable along with the selector without moving the piston rods not part of the selection, the selector comprises engage means configured to engage or disengage at least one of the piston rods such that engaged piston rods are simultaneously movable by the selector without moving disengaged piston rods, and the control means is configured to control the engage means such that the engage means engage the piston rods of the selection and disengage the piston rods not part of the selection.

2. Colorant fluid dispensing device according to claim 1, wherein the selector is movable along a selector trajectory from a start position to an end position and the control means is configured to change the engagement and disengagement of the engage means on the piston rods only when the selector is positioned in the start position.

3. Colorant fluid dispensing device according to claim 1, wherein the piston pumps are double acting piston pumps.

4. Colorant fluid dispensing device according to claim 3, wherein the input means is configured to provide a second input to the control means, which second input indicates a quantity of colorant fluid to be dispensed by each of the double acting piston pumps of said selection and out of the at least one dispenser outlet, the control means is configured to control the drive means such that the selector is moved from the start position to a return position located on the selector trajectory and back to the start position, said return position being determined by the largest displacement of the piston rods of the selection required for dispensing the by the second input indicated quantity of colorant fluid.

5. Colorant fluid dispensing device according to claim 4, wherein said return position is chosen such that the displacement of the selector from the start position to the return position and back to the start position equals the largest displacement of the piston rods of the selection required for dispensing the by the second input indicated quantity of colorant fluid.

6. Colorant fluid dispensing device according to claim 4, wherein said return position is chosen such that the displacement of the selector from the start position to the return position and back to the start position equals between the 1.05 and 1.15 times the largest displacement of the piston rods of said selection required for dispensing the by the second input indicated quantity of colorant fluid.

7. Colorant fluid dispensing device according to claim 6, wherein between 5% and 15% of the movement of the selector along the trajectory is used to build up a pressure in the colorant fluids in the double acting piston pumps of the selection.

8. Colorant fluid dispensing device according to claim 3, wherein each double acting piston pump is connected to one of the fluid containers via a first fluid connection and to one of the dispenser outlets via a second fluid connection, each of said second fluid connections comprises a three-way valve which via a third fluid connection is connected to the fluid container being connected to said double acting piston pump via said first fluid connection and the control means are configured to control the three-way valves during the movement of the selector along the selector trajectory such that from the colorant fluids pumped by the double acting piston pumps of the selection the by the second input indicated quantity of each colorant fluid is dispensed out of the at least one dispenser outlet and the additional pumped colorant fluid is returned to the fluid container.

9. Colorant fluid dispensing device according to claim 1, wherein the colorant fluid dispensing device comprises a base frame for positioning the colorant fluid dispensing device in a use position on a surface and the central pump tubes of the piston pumps in said use position extend substantially parallel to said surface.

10. Colorant fluid dispensing device according to claim 9, wherein the central pump tubes of the piston pumps in said use position extend substantially horizontal.

11. Colorant fluid dispensing device according to claim 10, wherein the double acting piston pump comprises a pump inlet for letting in the colorant fluid and a pump outlet for letting out the colorant fluid.

12. Colorant fluid dispensing device according to claim 11, wherein in said use position the pump outlet of the double acting piston pump is located at a larger distance from said surface than the pump inlet thereof.

13. Colorant fluid dispensing device according to claim 11, wherein the pump inlet and the pump outlet of the double acting piston pump are positioned such that in the use position a plane extending through the pump inlet and the pump outlet extends substantially perpendicular to said surface.

14. Method for dispensing a colorant fluid with a colorant fluid dispensing device comprising more than one fluid container for containing a colorant fluid, at least one dispenser outlet for dispensing the colorant fluids of the fluid containers, wherein the fluid containers are in fluid connection with the at least one dispenser outlet via pumping means for pumping said colorant fluids of the fluid containers out of the at least one dispenser outlet, the pumping means comprises more than one piston pump, each piston pump comprises a central pump tube in which a piston is provided, the piston being connected to a piston rod for moving the piston inside the central pump tube, the colorant fluid dispensing device further comprises driving means for moving the piston rods of said piston pumps, control means for controlling the driving means, and input means for providing a first input to the control means, which first input indicates a selection of multiple piston rods, and the driving means comprises a movable selector, said method comprising the steps of:

engaging the piston rods of the selection with the selector such that the piston rods of the selection are simultaneously movable along with the selector without moving the disengaged piston rods not part of the selection, and moving the selector such that the piston rods of the selection are moved simultaneously along with the selector without moving the piston rods not part of the selection.

* * * * *